US012560047B2

(12) United States Patent
Johnson

(10) Patent No.: US 12,560,047 B2
(45) Date of Patent: Feb. 24, 2026

(54) RISERLESS MARINE PACKAGE

(71) Applicant: GRANT PRIDECO, INC., Houston, TX (US)

(72) Inventor: Austin Johnson, The Woodlands, TX (US)

(73) Assignee: GRANT PRIDECO, INC., Houston, TX (US)

( * ) Notice: Subject to any disclaimer, the term of this patent is extended or adjusted under 35 U.S.C. 154(b) by 0 days.

(21) Appl. No.: 18/959,157

(22) Filed: Nov. 25, 2024

(65) Prior Publication Data

US 2025/0092755 A1 Mar. 20, 2025

Related U.S. Application Data

(63) Continuation of application No. PCT/US2023/024127, filed on Jun. 1, 2023.

(60) Provisional application No. 63/348,158, filed on Jun. 2, 2022.

(51) Int. Cl.
*E21B 33/064* (2006.01)
*E21B 33/08* (2006.01)

(52) U.S. Cl.
CPC ..... *E21B 33/085* (2013.01); *E21B 33/064* (2013.01)

(58) Field of Classification Search
CPC .... E21B 33/085; E21B 33/064; E21B 33/128; E21B 41/10
USPC ..... 166/335
See application file for complete search history.

(56) References Cited

U.S. PATENT DOCUMENTS

| | | | | |
|---|---|---|---|---|
| 1,105,171 | A | 7/1914 | John | |
| 6,325,159 | B1 * | 12/2001 | Peterman | E21B 21/08 166/359 |
| 9,062,498 | B2 * | 6/2015 | Potter | E21B 7/128 |
| 9,909,379 | B2 | 3/2018 | Fraczek et al. | |
| 9,939,097 | B2 | 4/2018 | Pendleton | |
| 9,970,247 | B2 | 5/2018 | Fraczek et al. | |

(Continued)

OTHER PUBLICATIONS

PCT International Search Report issued in PCT International Application PCT/US2023/024127, filed on Jun. 1, 2023, mailed on Aug. 18, 2023.

(Continued)

*Primary Examiner* — Nicole Coy
*Assistant Examiner* — Douglas S Wood
(74) *Attorney, Agent, or Firm* — Basil M. Angelo; ANGELO IP

(57) ABSTRACT

A riserless marine package enables post-BOP utilization of both drill centers simultaneously using an offset riser system to significantly reduce turnaround time between drilling and casing operations and reduce associated costs. A sealing system of the riserless marine package, disposed above the subsea BOP, separates the drilling mud below the sealing system from the seawater above. Drillstrings and casing strings are run through the seawater and transit through the sealing device of the riserless marine package. The rig may assemble and operate a drillstring from the first drilling position and assemble and operate a casing or liner string in the second drilling position. Upon reaching total depth using the offset riser, the rig may trip the drillstring until the BHA clears the subsea BOP. Once the BHA clears the subsea BOP, the rig may then move to insert a casing string hanging from the second drilling position into the well.

47 Claims, 20 Drawing Sheets

(56) References Cited

U.S. PATENT DOCUMENTS

| | | | |
|---|---|---|---|
| 10,012,031 | B2 | 7/2018 | Fraczek et al. |
| 10,174,869 | B2 | 1/2019 | Erickson et al. |
| 10,301,886 | B2 | 5/2019 | Walker et al. |
| 10,392,890 | B2 | 8/2019 | Fraczek et al. |
| 10,520,120 | B2 | 12/2019 | Fraczek |
| 10,577,878 | B2 | 3/2020 | Johnson et al. |
| 10,590,721 | B2 | 3/2020 | Johnson et al. |
| 10,612,317 | B2 | 4/2020 | Fraczek et al. |
| 10,655,403 | B2 | 5/2020 | Fraczek et al. |
| 10,655,410 | B2 | 5/2020 | Johnson et al. |
| 10,689,929 | B2 | 6/2020 | Fraczek et al. |
| 10,781,956 | B2 | 9/2020 | Fraczek et al. |
| 10,837,239 | B2 | 11/2020 | Fraczek et al. |
| 10,995,573 | B2 | 5/2021 | Fraczek et al. |
| 11,008,825 | B2 | 5/2021 | Fraczek et al. |
| 11,035,186 | B2 | 6/2021 | Fraczek et al. |
| 11,248,434 | B2 | 2/2022 | Fraczek et al. |
| 11,274,502 | B2 | 3/2022 | Fraczek et al. |
| 11,306,550 | B2 | 4/2022 | Johnson et al. |
| 11,306,551 | B2 | 4/2022 | Johnson et al. |
| 11,332,998 | B2 | 5/2022 | Johnson et al. |
| 11,339,619 | B2 | 5/2022 | Fraczek et al. |
| 11,339,620 | B2 | 5/2022 | Johnson et al. |
| 11,377,922 | B2 | 7/2022 | Johnson et al. |
| 11,466,524 | B2 | 10/2022 | Johnson et al. |
| 11,499,380 | B2 | 11/2022 | Fraczek et al. |
| 11,619,107 | B2 | 4/2023 | Fraczek et al. |
| 11,668,145 | B2 | 6/2023 | Fraczek et al. |
| 12,071,846 | B2 | 8/2024 | Johnson |
| 2006/0231264 | A1* | 10/2006 | Boyce ..... E21B 7/124 166/363 |
| 2008/0264643 | A1* | 10/2008 | Skeels ..... E21B 33/076 166/348 |
| 2009/0101351 | A1* | 4/2009 | Hannegan ..... E21B 33/085 166/350 |
| 2010/0018715 | A1* | 1/2010 | Orbell ..... E21B 21/106 166/345 |
| 2022/0205335 | A1* | 6/2022 | Martins ..... E21B 33/128 |
| 2022/0381105 | A1* | 12/2022 | Wilson ..... E21B 21/08 |
| 2024/0254842 | A1 | 8/2024 | Johnson et al. |

OTHER PUBLICATIONS

PCT Written Opinion issued in PCT International Application PCT/US2023/024127, filed on Jun. 1, 2023, mailed on Aug. 18, 2023.

* cited by examiner

700

RISERLESS MARINE PACKAGE

CROSS-REFERENCE TO RELATED APPLICATIONS

This application is a continuation of PCT International Application PCT/US2023/024127, filed on Jun. 1, 2023, which claims the benefit of, or priority to, U.S. Provisional Patent Application Ser. No. 63/348,158, filed on Jun. 2, 2022, all of which are hereby incorporated by reference in their entirety for all purposes.

BACKGROUND OF THE INVENTION

Drilling fluid, sometimes referred to as mud, plays an important role in modern rotary drilling systems. Drilling fluid is used to cool and lubricate the drill bit, remove cuttings from the well, and maintain primary well control of the well. Primary well control is established when the wellbore pressure exerted by the drilling fluid is simultaneously higher than the formation pore pressure and lower than the formation fracture pressure for all uncased formations. The area between the formation pore pressure and the formation fracture pressure is generally known as the drilling window.

Drilling fluid is typically a liquid that is combined with other agents having a density greater than or equal to the density of the liquid base. In special cases, some drilling operations use foam or air as the drilling fluid, but the purpose of the drilling fluid is the same. Drilling fluid exerts a hydrostatic pressure on the formation as a function of the true vertical depth ("TVD") and the fluid density. To maintain the wellbore pressure within the drilling window, the rig crew precisely controls the density and viscosity of the drilling fluid to ensure that the hydrostatic pressure is greater than the pore pressure when the mud pumps are off and that the dynamic downhole pressures do not exceed the fracture pressure when the mud pumps are on. If the wellbore pressure drops below the pore pressure, unknown fluids, potentially including explosive gases, stored in the pore spaces of the rock may undesirably migrate into the wellbore in an event known as a kick. If the wellbore pressure exceeds the fracture pressure, pathways in the formation may begin to open allowing wellbore fluids to undesirably flow into the formation in an event known as a loss. Friction caused by the rotation of drill pipe and the circulation of fluids also increases the actual downhole pressure exerted above the hydrostatic pressure alone.

In conventional drilling systems, primary well control is established mainly by the drilling fluid disposed within the wellbore, which is open to the atmosphere at the surface. Notably, in a conventional drilling system, friction acts downhole against the open hole formations, which is typically the weakest and most sensitive part of the circulating system. The rig crew may adjust the downhole pressure by displacing the active drilling fluid with another, however this process may take several hours, and it is not always clear what adjustments should be made to the drilling fluid to avoid a kick or loss event. In the event primary well control is lost, forward progress toward the target stops and the rig crew must initiate secondary well control measures.

A blowout preventer ("BOP") is part of the secondary well control system and is a critical safety component in modern drilling systems. The BOP sits atop the wellhead during drilling operations and acts as a safety valve during the drilling of the well. The BOP is a fixture of the drilling rig that is installed during drilling and removed when the drilling phase is completes. Under normal operating conditions, while drilling, the BOP is open, and the rig crew uses the drilling fluid to maintain primary control. If the drilling rig loses primary control, secondary well control measures are taken which include closing the BOP and performing well control circulation procedures to re-establish primary well control. Infiltration of potentially explosive gas into the well system during drilling is problematic and potentially dangerous. As influx gas displaces mud in the wellbore, the hydrostatic pressure applied by the mud is reduced due to the lower density of gas relative to liquid components of mud. This has the effect of transferring high pressure from the reservoir, or kicking zone, up the wellbore to the BOP. In the event of an influx of a small volume of gas, the additional pressure may be relatively low, and the rig may only need to circulate the kick out of the well and displace the original mud with a heavier kill mud. In large gas influx events, the transfer of high pressure from lower formations onto weaker components in the well is likely to cause a failure. If failure happens in the open hole section, the drilling rig runs the risk of losing the open hole section due to the breakdown of otherwise competent formations. Failure of a BOP is considered an unacceptable risk. If the BOP fails during a secondary well control event, human life onboard the rig is put in danger and the ability of the rig to mitigate the situation safely is severely impaired.

BOPs include an array of sealing mechanisms to ensure the drilling rig does not experience a blowout. While configurations of BOPs vary, they typically include at least one set of pipe rams which seal on the outer diameter of the drill pipe body section, but not the drill pipe tool joint section. Typically, BOPs also include at least one blind shear ram which cuts the pipe in case of an emergency, to allow the ram to close and seal the well. Typically, BOPs also include at least one annular packer system. Annular packer systems have the advantage of being able to seal on non-standard geometries, whereas rams typically seal on pipe body or blind shear the pipe. Other types of BOP ram sealing elements exist and may be included in the BOP stack depending on the needs of the operation or the preference of the operator.

In the early days of offshore drilling, the differences between onshore drilling technologies and offshore drilling technologies were very limited. To access offshore fields, operators were forced to build bottom supported jackets in the open ocean on which a conventional land rig was assembled. Building such a facility was a significant undertaking given the available technology, but the water depth the operator could commercially operate within was typically not much more than 100 feet. As the offshore industry matured, offshore drilling technology became more sophisticated. Large steel jackets enabled drilling in deeper waters using more advanced versions of land rig technology. However, the economic feasibility of sourcing very large steel jackets is challenging, especially when estimates of hydrocarbon reserves are uncertain. As such, vessels, known as jack-up rigs, were developed that use a hull to float the vessel to a location where adjustable legs are lowered to the sea floor to lift the vessel out of the water. Jack-up rigs were a major step forward in offshore efficiency and increased the number of commercially feasible projects. Jack-up rigs, however, are water depth limited by the length of their legs, which may only be so long before the vessel becomes unstable. Further, risers can become quite heavy as operating depths and operating pressures increase, making them challenging to handle given the capacity of the vessel. To continue to explore efficiently in deeper waters, drillers began using floating vessels, such as, for example, drillships, with marine drilling systems to reach new targets. Dynamic positioning was developed to address the technical and economic challenge of mooring a deepwater drilling vessel over a station, allowing rigs to move quickly between locations while maintaining station keeping abilities.

Drilling in very deep water, far from shore, requires special considerations. Due to a lack of compaction near the seafloor, deepwater drillers are forced to use multiple conductor casing strings to get through mud and soft rock to get to a competent formation, meaning the number of casing strings usually grows to 6 or 7 compared to onshore wells, which typically use 3 or 4 casing strings. This grew the requirement for pass through diameter, which, along with increased pressure requirements, made the continued use of surface-type BOP systems impossible.

Marine subsea BOP systems represented a step change in deepwater exploration technology. Rather than using thousands of feet of high pressure 10,000 or 15,000 psi rated riser, the use of marine subsea BOP systems disposed at the sea floor allowed the marine riser specification to be lowered, significantly reducing the weight of the marine riser. The marine riser remained as a conduit for drilling returns between the subsea BOP and the processing equipment at the surface, while also adding conduits for the choke and the kill lines between the subsea BOP and the well control equipment at the surface. The use of riser tensioning systems and a telescopic slip joint at the top of the riser allowed the floating rig to move up and down with the movement of the water without damaging the marine riser while flexible hoses connected the choke and the kill lines from a termination joint on the marine riser to a corresponding termination point on the drilling rig. With the subsea BOP disposed at the sea floor, new methods for controlling the BOP stack were also devised. Umbilicals containing hydraulic control lines, communications, and electric power were developed to allow the rig crew at the surface to operate the BOP as if it were at the surface. Typically, a drilling rig will have two umbilical systems so that a backup secondary umbilical exists in case the primary umbilical fails. Mechanisms for robotic intervention using a remote operated vehicle ("ROV") were also developed to help the rig install the subsea BOP on the wellhead and to act as a backup in case the umbilicals failed. Moving the BOP from the surface to seafloor also spawned the development of several new types of systems which did not previously exist.

Connecting the marine riser directly to the subsea BOP is not optimal, so a lower marine riser package ("LMRP") system was developed to serve as the interface between the subsea BOP and the marine riser. The LMRP has several functions. First, the subsea BOP is fixed to the wellhead while the marine riser is hung from the drilling rig; without the ability to flex and move with the drilling rig, the marine riser would impose bending forces on the connections between the marine riser and the subsea BOP and the subsea BOP and the wellhead with potentially catastrophic effect. To mitigate this risk, flexible joints were added to the LMRP to allow the marine riser to bend relative to the subsea BOP without damaging the system. Flexible lines for the choke and the kill lines were also added as part of the riser termination assembly which connects the LMRP to the marine riser. Second, the LMRP serves as the termination point for the subsea BOP umbilicals. Terminals on the LMRP accept a corresponding termination head on the end of an umbilical, making connections for the various functions. Some of the umbilical controls operate functions on the LMRP while others operate functions on the subsea BOP stack. Communication and control lines between the LMRP and the subsea BOP pass through another terminal near the LMRP and the subsea BOP interface. This allows the LMRP and the subsea BOP to be easily separated. Third, the LMRP includes the functionality to disconnect the marine riser from the subsea BOP stack in an emergency. This is a critical safety feature in weather related or station keeping contingency events. If high heave action of the drilling rig exceeds the limits of the telescopic slip joint or if the dynamic positioning system fails, the drilling rig may close the subsea BOP and disconnect the LMRP from the subsea BOP stack. Importantly, during a disconnect event, the umbilicals remain connected to the LMRP while the subsea BOP remains on the wellhead. During this time, the subsea BOP is inoperable until the LMRP is reconnected, or some other intervention method is employed. Once the weather subsides or the station-keeping fault is fixed, the drilling rig may return to the location, reattach the LMRP and operate the subsea BOP.

Significant investments have been made in riser handling equipment, riser tensioning equipment, riser storage onboard the drilling rig, lifting and tensioning capacities of the vessel to run, retrieve, and safely operate the subsea BOP, the LMRP, and the marine riser. Dedicated areas near the moon pool on a deepwater drilling rig exist for maintaining and testing the subsea BOP and the LMRP. The rig crew will usually install the umbilical system and test the features of the subsea BOP prior to deployment. During deployment, the combined subsea BOP, LMRP, and riser termination assembly is moved under a primary drilling position with the umbilicals attached. The rig then removes the rotary table from the drilling floor and installs a device for running riser, typically referred to as a riser spider. Riser tubulars are then picked up from an onboard storage area, handled using several different machines, then lifted vertical above the riser spider. The riser spider is opened then the first riser joint is lowered and made up to the riser termination assembly on the LMRP. The entire BOP/LMRP is then lifted by the first riser joint and the hoisting system, then the BOP trolley is moved out of the way. The entire stack of the subsea BOP, the LMRP, and the riser is lowered and hung from the top flange of the riser joint in the closed riser spider. Umbilical lines are secured to the first riser joint using clamps and a second joint of riser is collected from the storage area. The second joint of riser is made up to the first and the entire stack is lifted by the second riser joint and the hoisting system. The stack is lowered and hung from the top flange of the second riser joint in the closed riser spider. Umbilical lines are secured to the second riser joint using clamps and another joint of riser is collected from the storage area. This process continues until the subsea BOP is near the wellhead. Once the subsea BOP is within a predetermined elevation of the wellhead, other specialty joints are picked up. While exact configurations vary, usually the next specialty joint picked up is the termination joint. The termination joint includes attachment points for flexible auxiliary line hoses. The hoses are attached to the riser joint. The termination joint may also include a tension ring and an integral telescopic slip joint in a locked state. A flexible joint may be installed atop the slip joint or as part of the diverter assembly. The rig crew may then rig up a riser tensioning system to the riser to transfer the load from the hoisting system to the tensioning system. Once this is complete, the telescopic joint may be unlocked so that an upper portion of the slip joint is attached to the diverter. Finally, the subsea BOP is connected to the wellhead. Similar steps are performed in reverse order to disassemble the riser string after a well has been drilled. While specific configurations vary, there are many steps to running a marine riser, a considerable amount of equipment required to perform the operation, and it is very expensive.

Running tools for a marine riser are generally one of two types. The first category of riser running tool makes up to an end connection of the riser. Tools used in the assembly of a riser string generally lift the riser string by the top end connection of the uppermost joint of riser. Tools of this variety may be constructed from a compatible bottom end flange or similar geometry. Other features may be included to enable quick attachment of the tool, easy manipulation of the tool, or pressure testing. The second category of riser running tool exists which allows the riser to be lifted from an internal feature rather than by the end connection. In this category, a tool is run through the main tube of the marine riser having a smaller outer diameter ("OD") than the riser inner diameter ("ID"). Upon reaching a corresponding internal feature within a riser joint, the running tool may be activated, causing a locking mechanism on the tool to engage a locking mechanism on the riser joint. This category of riser running tool is mainly used in situations where the rig cannot efficiently gain access to a top end connection of a riser joint in the string as may be the case during field development where the subsea BOP must be moved between multiple wells generally in the same area. The first category of riser running tools is very common and generally considered required equipment to operate a riser string. The second category of riser running tools are less common and are typically only used in specialized cases. One drawback of the first type is that it cannot fit through a rotary table, so the drilling rig must perform substantial portions of the riser string disassembly process then perform substantial portions of the riser string assembly process just to move the subsea BOP between nearby wellheads. One drawback of the second type is that it typically requires advanced planning so that a dedicated joint of riser, containing the correct internal feature, is run as part of the riser string.

While the core activity of drilling is similar, as described above, deepwater drilling rigs require substantially more support systems than land based drilling rigs, driving the cost of deepwater drilling substantially higher than onshore drilling. To justify a drilling expense, operators must seek out reservoir targets with the highest productivity in terms of both the expected production rate and return on investment. This is especially true in deepwater where daily operating costs may exceed ten times those of an onshore well. To succeed in deepwater, operators must work in fields with large net pay sections, high quality hydrocarbon content, and high permeability. However, these same benefits which draw operators to deepwater, present a number of technical challenges to drilling from a floating vessel that test the practical limit of conventional drilling technologies.

BRIEF SUMMARY OF THE INVENTION

According to one aspect of one or more embodiments of the present invention, a riserless marine package includes a housing having an upper connection end, a lower connection end, and a central bore having an inner diameter corresponding to an inner diameter of a central bore of a subsea blowout preventer. The lower connection end of the housing fluidly connects the riserless marine package to the subsea blowout preventer. Riserless marine package may include a multi-purpose annular packer and latching mechanism having an annular packer comprising a central bore having an inner diameter corresponding to the inner diameter of the central bore of a subsea blowout preventer, a first upper latching mechanism disposed above the annular packer, and a first lower latching mechanism disposed below the annular packer. Riserless marine package may include a lower seal group disposed below the multi-purpose annular packer and latching mechanism having an upper annular sealing element comprising a central bore having an inner diameter corresponding to the inner diameter of the central bore of the subsea blowout preventer, a second upper latching mechanism disposed above the upper sealing element, a second lower latching mechanism disposed below the upper sealing element, a lower annular sealing element comprising a central bore having an inner diameter corresponding to the inner diameter of the central bore of the subsea blowout preventer, a third upper latching mechanism disposed above the lower sealing element, and a third lower latching mechanism disposed below the lower sealing element. Riserless marine package may include a buffer chamber disposed in between the multi-purpose annular packer and latching mechanism and the lower seal group having a central bore having an inner diameter at least as large as a smallest inner diameter of any other component of the riserless marine package, a fluid injection port, and a fluid return port. Riserless marine package may include an annular fluid return port disposed below the lower seal group, where the riserless marine package is removably attached to the subsea blowout preventer and the central bore of the riserless marine package is in fluid communication with the central bore of the subsea blowout preventer.

Other aspects of the present invention will be apparent from the following description and claims.

DETAILED DESCRIPTION OF THE INVENTION

Figure 1A:
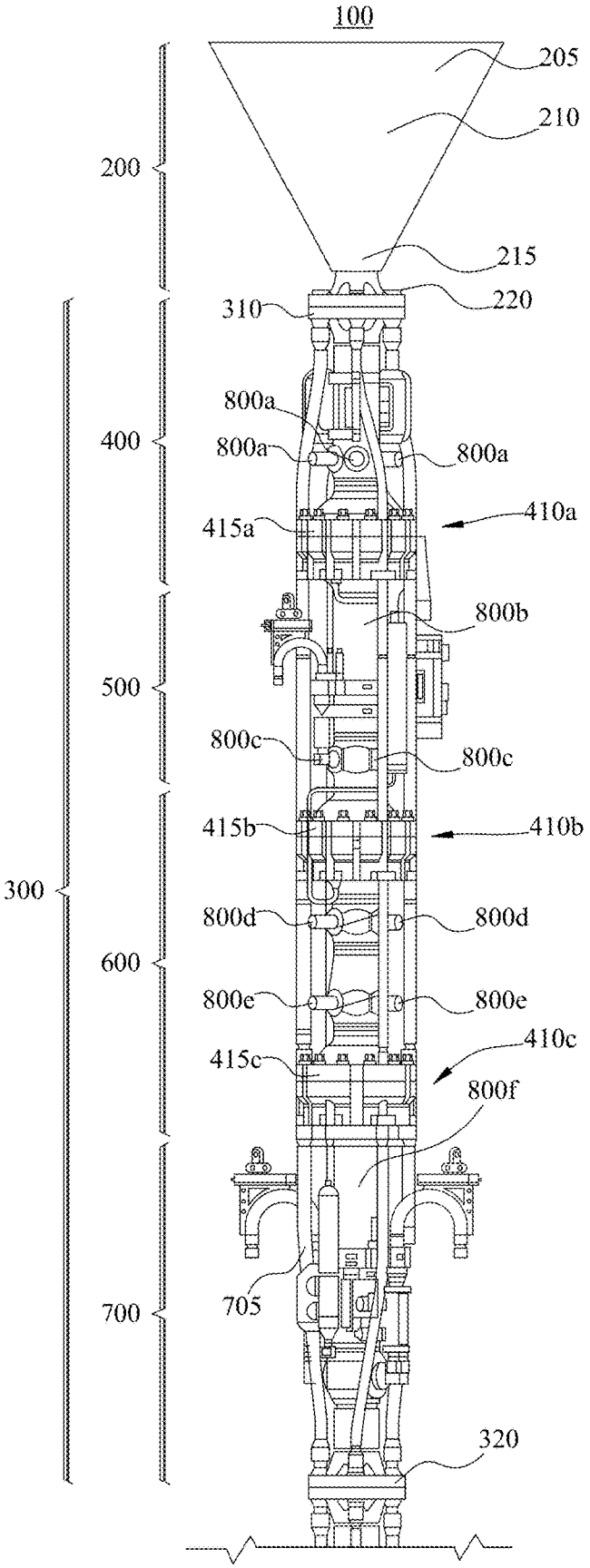
FIG. 1A shows a riserless marine package with a removably attached input guide in accordance with one or more embodiments of the present invention.

One or more embodiments of the present invention are described in detail with reference to the accompanying figures. For consistency, like elements in the various figures are denoted by like reference numerals. Letters appended to the end of a reference numeral, such as, for example, 100*a*, 100*b*, and 100*c*, are used to signify different instances of the same component. As such, a generic reference to component 100 applies with equal force to each instance of 100*a*, 100*b*, and 100*c*. In the following detailed description of the present invention, specific details are described to provide a thorough understanding of the present invention. In other instances, aspects that are well-known to those of ordinary skill in the art are not described to avoid obscuring the description of the present invention. For the purposes of this disclosure, upper or top refer to portions of apparatus that are disposed above, or closer to, the surface or are relatively disposed above a correspondingly named lower or bottom portion. Similarly, lower or bottom refer to portions of apparatus that are below, or closer to, the bottom of the wellbore or are relatively disposed below a correspondingly named upper or top portion.

One particularly important advancement in drilling technology is Managed Pressure Drilling ("MPD"). MPD is an adaptive form of drilling in which the annular pressure of the well is actively manipulated, typically to maintain wellbore pressure within the drilling window. The are many types of MPD, but the most commonly used is Applied Surface Back Pressure ("ASBP") MPD. ASBP MPD uses a wellbore sealing device to seal the wellbore and enable closed-loop drilling. One or more choke valves, as part of an MPD manifold, typically disposed on the surface, are used to control the pressure from the surface while a flow meter measures the return flow from the well. The rig crew can control the downhole pressure through the application of back pressure from the surface. In deepwater wells, an MPD specialty joint containing a wellbore sealing device is typically made up to the marine riser near the surface.

MPD techniques substantially enhance the drilling rig ability to manage wellbore pressure and, for example, in some applications maintain wellbore pressure within the drilling window. In an ASBP MPD operation, mud slightly less dense than that of conventional mud may be used to lower downhole pressures while drilling and circulating. The one or more choke valves of the MPD manifold may be used to adjust the surface back pressure during connections or other non-circulating operations. This approach allows the drilling rig to maintain constant pressure at a downhole anchor point by applying a lower surface pressure while drilling (when friction pressure is high) and applying a higher surface pressure during non-circulating events (when friction pressure is lower).

The key component of an MPD or other closed-loop drilling system is a wellbore sealing system. Initially, closed-loop drilling was achieved using passive wellbore sealing systems known as Rotating Control Devices ("RCDs"). Conventional RCDs use a passive sealing element attached to bearing assembly. The passive sealing element stretches to form an interference fit with the outer diameter of the drillstring or tubular member disposed therethrough and the bearing assembly permits the passive sealing element to rotate with the drillstring or tubular member to reduce pipe motion relative to the passive sealing element. The bearing assembly and the passive sealing element form a seal assembly which is run in the hole and lands in a dedicated housing. RCDs have been used onshore for several decades and are a good fit for land applications due to their short stack height and simple means of operation.

As deepwater exploration increased, RCD technology was adapted for use in deepwater applications. However, as with high pressure risers and surface-based BOP systems, the increased size and technical specifications required in deepwater applications only amplified design shortcomings of conventional onshore RCD technology. In addition, larger diameters increase the wear rate of rotary-type seals, driving the need for more precise manufacturing. Limited access to subsea RCD components further complicates matters and slows seal assembly replacement, often requiring several hours to complete. During non-closed-loop drilling hole sections, protective sleeves must be run to protect inner sealing faces of the RCD housing. Despite the added complexity required to use conventional RCD technology in deepwater applications, RCDs still fail without warning due to wear or splitting of the passive sealing elements, failure of static seals in the bearing assembly, or failure of the rotary seals in the bearing assembly. Upon detection of a failure, the drilling rig must stop all drilling activities and replace the RCD sealing assembly before resuming drilling operations.

Active Control Device ("ACD") technology was purpose built to create a wellbore sealing system for deepwater drilling applications that addressed the many shortcomings of conventional RCD technology in deepwater applications. In ASBP MPD systems, an ACD riser joint, sometimes referred to as an MPD specialty joint, is integrated into a drilling riser directly below the termination joint. The ACD contains no rotating parts and uses a surface-based active control system to controllably actuate the one or more active sealing elements. At the start of an MPD hole section, a retrievable seal assembly, including a non-rotating dual seal sleeve, is run on the drillstring into the ACD disposed subsea, and held in place by a latching mechanism, such as, for example, retractable locking dogs. The retractable locking dogs lock the retrievable seal assembly in place during operation but do not obstruct the bore when the seal assembly is removed. The wellbore seal is initialized by closing the annular packers on the outer diameter of the active sealing elements. Closing the annular packers causes the retrievable sealing elements to deflect radially inward until they make contact with the drillstring, forming a seal. This arrangement, combined with an active control system, enables monitoring and adjustment of the seal quality without immediately replacing the seal assembly.

The ACD system for ASBP MPD applications uses dual annular packers to operate a dual seal sleeve assembly comprising two active sealing elements. A surface-based hydraulic pressure unit ("HPU") is used to controllably and independently apply closing pressure to the annular packers which in turn applies closing pressure on the active sealing elements. The amount of closing pressure applied may be varied based on the priorities of operator or the wear state of the dual seal sleeve. As the dual seal sleeve wears, the applied closing pressure may be increased so that the annular packer acting on it is moved to a more closed position to maintain the integrity of the seal. In addition, the closing pressure required to maintain the seal provides an indication of the wear state of the dual seal sleeve. As the dual seal sleeve wears, the closing pressure required to maintain the seal between the polyurethane buffer material and the drill pipe provides a reliable indication that the dual seal sleeve has or will shortly reach the end of its design life. In an ASBP MPD application, this is an indication that at least one of the two elements is worn and that the rig crew should plan to replace the active sealing elements soon. The seal wear indicator implies that limited rotating life remains. In practice, after receiving the seal wear indicator, the rig crew can strip the bottom hole assembly ("BHA") to a safe location to replace the seal assembly.

The ACD dual seal sleeve includes two active sealing elements, each consisting of a polytetrafluoroethylene ("PTFE") honeycomb insert co-molded with polyurethane. The PTFE insert provides wear resistance for contacting the drillstring. The polyurethane holds the PTFE insert in place and provides a buffer material between the annular packer and the seal insert. The PTFE honeycomb insert is machined from a blank PTFE cylinder. Machining of the honeycomb pattern into the PTFE insert reduces the stiffness of the insert and strengthens the bond between the PTFE insert and the polyurethane. The ACD dual seal sleeve runs in the hole relaxed. An ACD alternate running tool is a retrievable running tool run as part of the drillstring on a temporary basis to allow retrieval of used seal assemblies and running of replacement seal assemblies. The alternate running tool does not require any cables or hoses to be run in the hole, reducing run time and the risk of dropping objects downhole. The ACD seal sleeve elements remain relaxed until energized with an inner diameter greater than the tool joint outer diameter. With the dual seal sleeve assembly in place, the ACD creates a wellbore seal by applying radial closing force to the active sealing elements. The system activates the active sealing elements by injecting hydraulic fluid into the closing chamber of the ACDs spherical annular packers to energize the active sealing elements. The closing chamber pressure adjusts independently for each active sealing element, permitting the optimization of the life of each active sealing element.

A closed-loop active directly-hydraulic control system operates the ACD. Control remains at the surface with the system containing no control valves or regulators subsea. Further, the closed-loop system allows the use of optimal hydraulic fluids to function the system while reducing the risk of contamination. As noted above, the ACD uses an active hydraulic control system capable of providing a seal wear indicator while the seal assembly is active subsea. The slow wear of the PTFE seal insert and polyurethane buffer material creates a change in the geometry of the active sealing element. Over the course of its operational life, rotation of the drillstring within the non-rotating active sealing element reduces the wall thickness of the element. Once the PTFE seal insert is worn, a higher closing force is required to create or maintain a seal between the remaining polyurethane buffer material and the drillstring due to the compression of the annular packer element. This relationship results in a clear signal that an active sealing element has reached or will shortly reach the end of its design life. Notably, the system can maintain and even re-establish seal integrity when the PTFE insert is worn.

While drilling from a floating rig, such as, for example, a drillship or semi-submersible presents unique challenges, it also presents unique advantages. The use of marine drilling systems enables the use of conventional pre-BOP dual activity workflows on deepwater drilling units, saving considerable time before the subsea BOP is installed. A conventional pre-BOP dual activity workflow includes a drilling rig with two drilling positions that allow the drilling rig to drill from the first position and prepare casing in the second position. Once the total depth is reached, the drilling rig trips the BHA back to the mud line. Once the drill bit is above the mud line, the dynamic positioning system moves the drilling rig so that the second drilling position is over the wellhead. The casing string is then tripped in the hole from just above the mud line to its total depth. Meanwhile, the drillstring is tripped to the surface and the BHA is changed for the next section. Once cementing is complete, the dynamic positioning system moves the drilling rig so that the first drilling position is over the wellhead and the drilling rig trips the new BHA in to begin drilling the next section. This approach reduces the amount of critical path time consumed; from a scheduling perspective, this dual activity workflow allows trips into and out of the hole to begin at the mud line, rather than at the drilling rig floor.

While dual activity drilling has been a reality for more than two decades, the major gains of dual activity operations are realized primarily before the subsea BOP is installed. The ability to make up a casing string in the second position while drilling from the first position presupposes that there is no marine riser installed. Once the marine riser is installed, all drillstring and casing string elements must be run concentrically within the marine riser. The implication of this distinction is that once the subsea BOP is installed, all trips into and out of the hole must begin at the rig floor, consuming drilling rig time while tools are tripped in and out and while changing handling tools at the surface.

While pre-BOP riserless drilling has proven benefits, post-BOP riserless drilling has not yet been realized. Deeper hole sections are often abnormally pressured and must be drilled with specialized oil or synthetic-based muds, often containing hazardous additives to prevent wellbore stability issues. Further, deeper hole sections often use drilling fluids with densities higher than sea water which would tend to drive drilling fluids across the seal element toward the sea through the U-tubing effect. It is crucial that none of these hazardous materials escape to the sea, so a closed-loop drilling system which forms a part of the primary well barrier is preferred. As such, despite best efforts, there is no commercially available riserless marine package or riserless drilling system that is capable of performing post-BOP dual activity workflow.

Riserless drilling presents significant opportunities for operations efficiency and cost savings in deepwater operations. At the outset, it is important to note that in the context of this disclosure, riserless drilling means drilling with an offset riser (for drilling returns and auxiliary line functions) that is disposed in a position offset from the installed riserless marine package/subsea BOP on the wellhead. As such, the drilling rig is not required to assemble a drillstring concentrically within a drilling riser, thereby simplifying operations and enabling post-BOP dual activity workflow. Post-BOP riserless drilling means drilling without a conventional marine riser once the subsea BOP is installed on the subsea wellhead. The riserless marine package disclosed herein is the primary component, that replaces the conventional LMRP, in a post-BOP riserless drilling system. Other components of a post-BOP riserless drilling system may include a conventional offset riser and associated support systems.

Accordingly, in one or more embodiments of the present invention, a riserless marine package is disclosed that enables post-BOP utilization of both drill centers simultaneously using a conventional offset riser system and associated support systems to significantly reduce turnaround time between drilling and casing operations, and substantially reduce associated costs. A sealing system of the riserless marine package, disposed above the subsea BOP, separates the drilling mud below the sealing system from the seawater above. Drillstrings and casing strings are run through the seawater and then transit through the sealing device of the riserless marine package. The drilling rig may assemble and operate a drillstring from the first drilling position and assemble and operate a casing or liner string in the second drilling position. Upon reaching total depth using the offset riser, the drilling rig may trip the drillstring until the BHA clears the subsea BOP. Once the BHA clears the subsea BOP, the drilling rig may then move to insert a casing string hanging from the second drilling position into the well. Similarly, the drilling rig may trip out casing running tools after a casing string is cemented in place and insert a ready drill string once casing tools clear the subsea BOP stack. This approach allows the drilling rig to partially remove tripping time and rig floor configuration time from the critical path of operations. By reducing the time on location, less fuel is consumed, less emissions are produced, and the overall well construction cost is substantially reduced.

The riserless marine package disclosed herein may be deployed in place of a conventional LMRP and is distinguishable in a number of ways. The riserless marine package includes termination points for umbilical jumpers and connection points for choke, kill, and hydraulic auxiliary lines, and a drilling fluid return flow line. Onboard control pods may control the operation of the riserless marine package. A detachable connection allows the riserless marine package to be run separate from the lower subsea BOP stack. The riserless marine package may include an ACD system to seal an annulus between drill pipe and a central bore of the riserless marine package. The ACD system allows for the sequential activation of sealing elements. A multi-purpose annular packer and cartridge latching system may allow the riserless marine package to seal on the OD of large diameter casing strings or, for drop sealing assemblies, to seal on smaller pipe diameters. Locking systems which hold seal assemblies in place during operation hold a running assembly to deploy and retrieve the system using passive tools.

FIG. 1A shows a riserless marine package 100 with a removably attached input guide 200 in accordance with one or more embodiments of the present invention. In one or more embodiments of the present invention, riserless marine package 100 replaces a conventional LMRP to enable post-BOP riserless drilling operations. Riserless marine package 100 may include housing 300, multi-purpose annular packer and latching mechanism 400, buffer chamber 500, lower seal group 600, and annular fluid return port 700.

In certain embodiments, riserless marine package 100 may use an input guide 110 for post-BOP riserless drilling operations. Tubular members (not shown) from the drilling rig (not shown) may be run into the wellhead (not shown) through open water rather than a marine riser (not shown). The purpose of input guide 110 is to guide tubular members (not shown) from open water into the central bore (e.g., 110 of FIG. 1C) of riserless marine package 100, to simplify tripping operations in the absence of a marine riser (not shown). In certain embodiments, input guide 200 may include an upper receiving end 205, a passageway 210 to a central bore (e.g., 110 of FIG. 1C) having an inner diameter (e.g., 120 of FIG. 1C) corresponding to an inner diameter (e.g., 120 of FIG. 1C) of a central bore (e.g., 110 of FIG. 1C) of riserless marine package 100 (and by extension, the subsea BOP), and a lower connection end 220. Lower connection end 220 may removably attach to an upper connection end 310 of riserless marine package 100. In certain embodiments, passageway 210 of input guide 200 may be shaped like a funnel (as shown) and taper down from a wider inner diameter (e.g., that shown at or near reference numeral 205) to a narrower inner diameter (e.g., that shown at or near reference numeral 215) corresponding to the inner diameter (e.g., 120 of FIG. 1C) of the central bore (e.g., 110 of FIG. 1C) of riserless marine package 100, which itself corresponds to the inner diameter of the central bore of the subsea BOP (not shown).

Figure 1B:
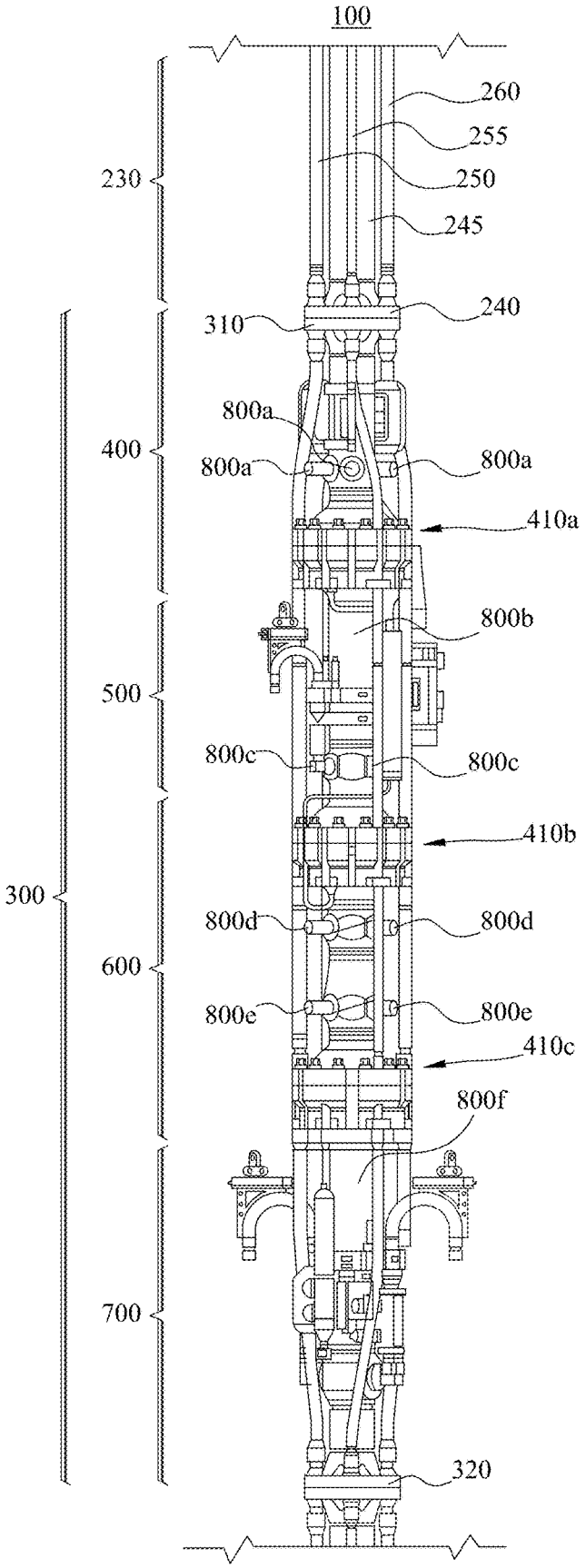
FIG. 1B shows a riserless marine package with a removably attached riser termination assembly installed in accordance with one or more embodiments of the present invention.

Continuing, FIG. 1B shows a riserless marine package 100 with a removably attached riser termination assembly 230 installed in accordance with one or more embodiments of the present invention. Riserless marine package 100 may be adapted for use in conventional drilling operations with a marine riser (not shown), essentially functioning as a conventional LMRP, thereby enabling both post-BOP riserless drilling operations as well as conventional drilling operations through the same riserless marine package 100.

The removably attached input guide (200 of FIG. 1A) may be removed from riserless marine package 100 and replaced with a riser termination assembly 230. Riser termination assembly 230 may include a conventional termination flange assembly (235, not shown), a lower connection end 240, and a tubular member 245 comprising a central bore having an inner diameter corresponding to the inner diameter (e.g., 120 of FIG. 1C) of the central bore (e.g., 110 of FIG. 1C) of riserless marine package 100. Riser termination assembly 230 may include a plurality of auxiliary lines (e.g., 250, 255, and 260 shown) disposed around riser termination assembly 230, with corresponding termination connection ends (not shown) disposed on conventional termination flange assembly 235 and lower connection end 240 to establish auxiliary line connections (e.g., choke, kill, hydraulic, and boost).

Conventional termination flange assembly 235 (not shown) of riser termination assembly 230 may include a conventional flex joint (not shown) and a termination flange (not shown) that removably attaches to a lower end of a conventional marine riser (not shown). Lower connection end 240 of riser termination assembly 230 may removably attach to upper connection end 310 of riserless marine package 100. Tubular member 245, comprising the central bore having the inner diameter corresponding to the inner diameter (e.g., 120 of FIG. 1C) of the central bore (e.g., 110 of FIG. 1C) of riserless marine package 100, may provide fluid communication between the marine riser (not shown), riserless marine package 100, and the subsea BOP (not shown).

Figure 1C:
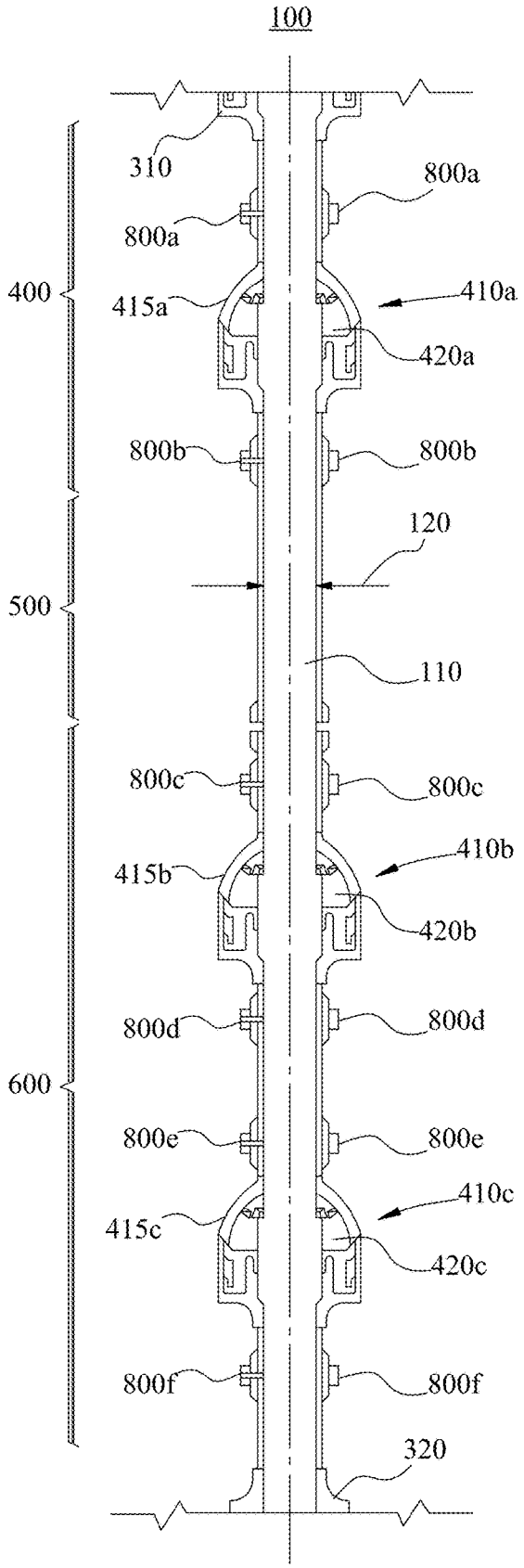
FIG. 1C shows a cross-sectional view of a central bore of a portion of riserless marine package in accordance with one or more embodiments of the present invention.

Continuing, FIG. 1C shows a cross-sectional view of a central bore 110 of a portion of riserless marine package 100 in accordance with one or more embodiments of the present invention. Riserless marine package 100 includes a number of components disposed in one or more housings (not shown), each of which comprises a central bore 110 having an inner diameter 120 that corresponds to the inner diameter (not shown) of the central bore (not shown) of the subsea BOP (not shown) to facilitate drilling and other operations. While nominal subsea BOPs, and by extension, certain embodiments of riserless marine package 100, have a central bore having an inner diameter of 19 inches, one of ordinary skill in the art having the benefit of this disclosure will recognize that inner diameter 120 of central bore 110 of riserless marine package 100 may vary based on an application or design in accordance with one or more embodiments of the present invention. In this way, central bore 110 establishes fluid connectivity between upper connection end 310 and lower connection end 320, and in operation, between riserless marine package 100, the subsea BOP (not shown), and the wellhead (not shown) that they are attached to.

Riserless marine package 100 may include a plurality of latching mechanisms 800 disposed about central bore 110 as discussed in more detail herein. For example, multi-purpose annular packer and latching mechanism 400 may include a plurality of first upper latching mechanisms 800*a* disposed above annular packer system 410*a* and a plurality of first lower latching mechanisms 800*b* disposed below annular packer system 410*a*. In this way, retrievable sealing elements (not shown) or tools (not shown) may be landed on the plurality of actuated first lower latching mechanisms 800*b* and secured in place by the plurality of first upper latching mechanism 800*a*. Similarly, lower seal group 600 may include a plurality of second upper latching mechanisms 800*c* disposed above the annular packer 410*b* and a plurality of second lower latching mechanisms 800*d* disposed below the annular packer 410*b*. In this way, retrievable sealing elements (not shown) may be landed on the plurality of actuated second lower latching mechanisms 800*d* and then secured in place by the plurality of actuated second upper latching mechanism 800*c*. Similarly, lower seal group 600 may include a plurality of third upper latching mechanisms 800*e* disposed above annual packer 410*c* and a plurality of third lower latching mechanisms 800*f* disposed below annular packer 410*c*. In this way, retrievable sealing elements (not shown) may be landed on the plurality of actuated third lower latching mechanisms 800*f* and then secured in place by the plurality of actuated third upper latching mechanism 800*e*.

Figure 2A:
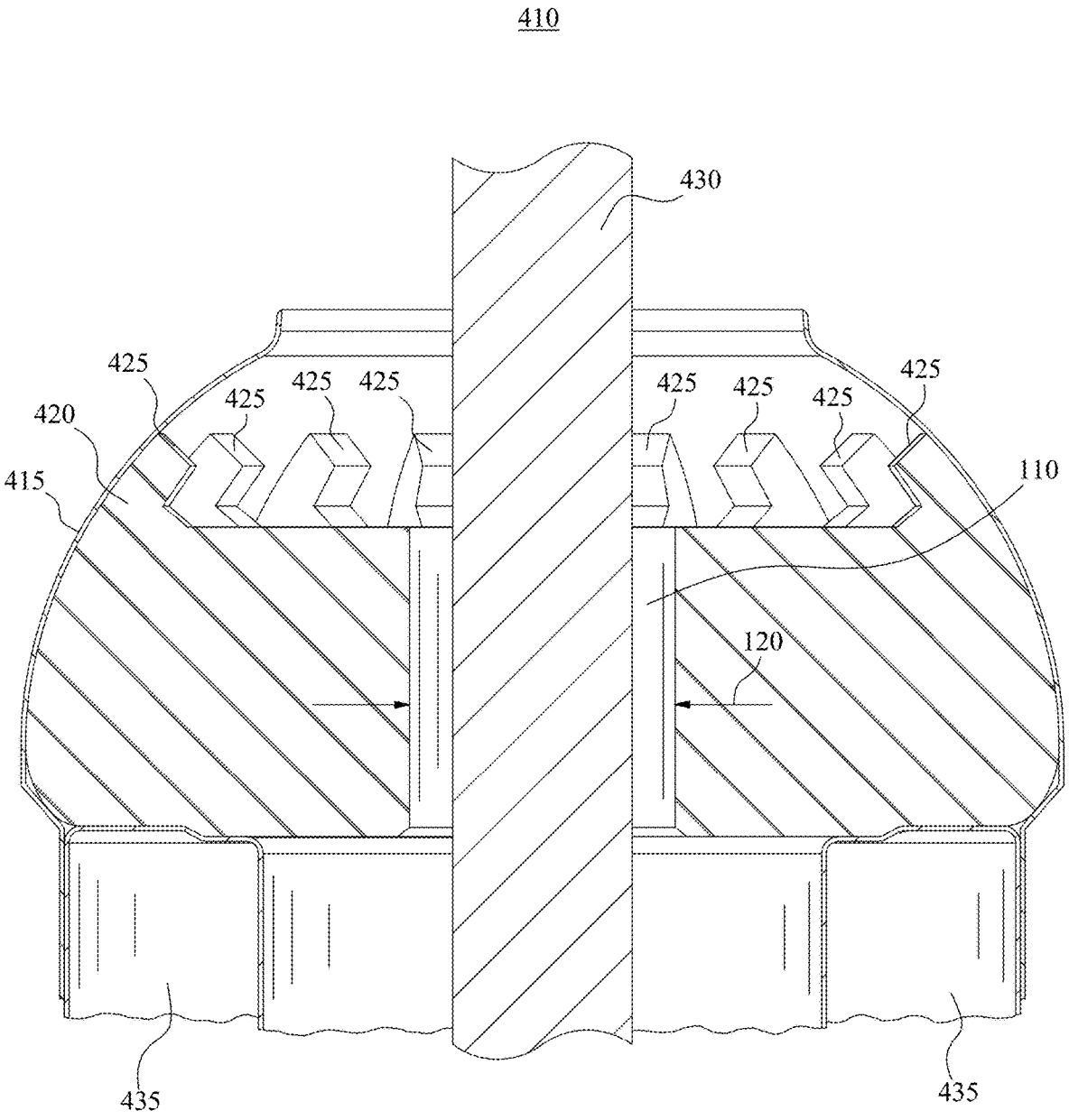
FIG. 2A shows a cross-sectional view of an annular packer system of a multi-purpose annular packer and latching mechanism of a riserless marine package in an unactuated state in accordance with one or more embodiments of the present invention.

FIG. 2A shows a cross-sectional view of an annular packer system 410 of a multi-purpose annular packer and latching mechanism 400 of a riserless marine package 100 in an unactuated state in accordance with one or more embodiments of the present invention. Annular packer system 410 may be disposed below, and in fluid communication with, the removably attached input guide (e.g., 200 of FIG. 1A) or the riser termination assembly (e.g., 230 of FIG. 1B).

Annular packer system 410 may include a housing portion 415 that may be a discrete component that is combined with other components to form the larger housing structure (e.g., 300 of FIG. 1A) of riserless marine package 100 or part of a singular integrated housing structure (not shown) of riserless marine package 100. Annular packer system 410 may include an annular packer member 420 having a central bore 110 in an unactuated state having an inner diameter 120 corresponding to the inner diameter (e.g., 120 of FIG. 1C) of the central bore (e.g., 110 of FIG. 1C) of riserless marine package 100 (and of the subsea BOP). Annular packer member 420 may be composed of an elastomer or rubber body, optionally including a plurality of protrusions 425. In certain embodiments, annular packer system 410 may receive, for example, a tubular member 430 directly through central bore 110.

Figure 2B:
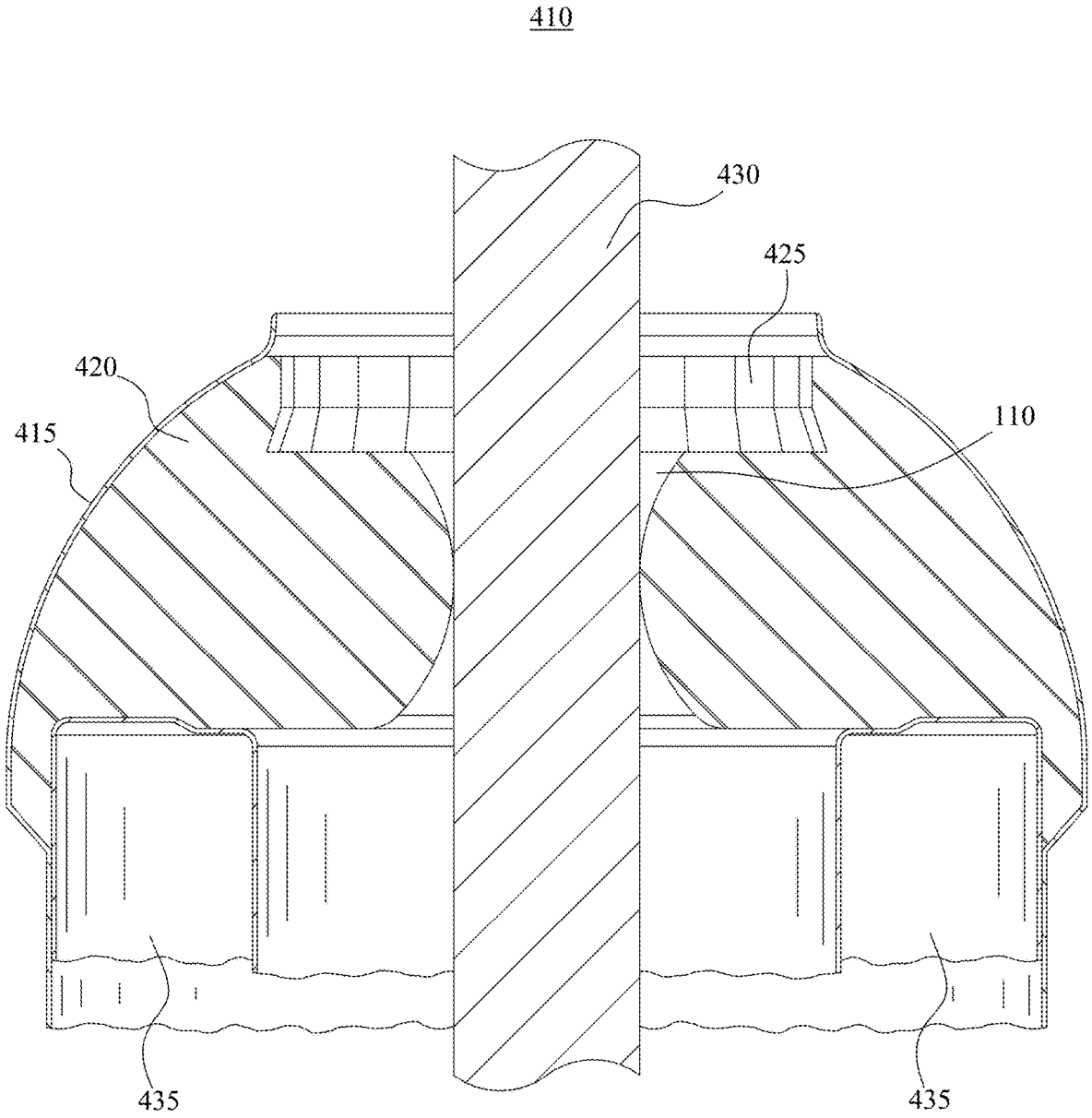
FIG. 2B shows a cross-sectional view of an annular packer system of a multi-purpose annular packer and latching mechanism of a riserless marine package in an actuated state in accordance with one or more embodiments of the present invention.

Continuing, FIG. 2B shows a cross-sectional view of annular packer system 410 of multi-purpose annular packer and latching mechanism 400 of riserless marine package 100 in an actuated state in accordance with one or more embodiments of the present invention. A piston-actuated hydraulic control system (not shown) may controllably, and to the degree desired, actuate a piston 435 that causes annular packer member 420 to travel within housing portion 415 and seal on tubular member 430 or any other or irregularly shaped members disposed therethrough. The degree to which annular packer member 420 travels depends on the amount of closing pressure applied by the piston-actuated hydraulic control system (not shown).

While conventional annular packers are designed to operate as a complete shut-off valve for the annulus, here, annular packer system 410 of multi-purpose annular packer and latching mechanism 400 serves a substantially different purpose, primarily, to operate various components of riserless marine package 100 during post-BOP riserless drilling operations. For example, during riserless drilling, a retrievable sealing element, such as, for example, a non-rotating ACD seal sleeve (not shown) may be deployed and actuated by closing annular packer 420 on the retrievable sealing element (not shown). During tripping or other times when a retrievable sealing element (not shown) is not installed, annular packer 420 may be used to seal on and clear tubular members 430 disposed therethrough. During the running and retrieval of riserless marine package 100, a plurality of latching mechanisms (e.g., 800 of FIGS. 1A, 1B, and 1C)

may be used in combination with a simplified running tool (not shown) to lift riserless marine package 100.

Advantageously, the design of multi-purpose annular packer and latching mechanism 400 can accept a sealing element of a standard outer diameter and length and configurable inner diameter or internal functionality. As such, multi-purpose annular packer and latching mechanism 400 is operable to seal on rigid bodies including an RCD seal and bearing assembly (not shown) or on flexible bodies, such as a non-rotating ACD seal sleeve, giving the flexibility to use either. As such, either RCD or ACD functionality may be achieved. Further, the drilling rig (not shown) has the ability to variably adjust the closing pressure applied to annular packer 420 or a sealing element (not shown) disposed therein, allowing the sealing element to potentially allow for controlled flow of fluids from above to below or from below to above the sealing element. Further, multi-purpose annular and latching mechanism 400 may receive a non-sealing element (not shown) of a standard outer diameter and length. One such non-sealing element (not shown) may be a simplified running tool (not shown). A simplified running tool (not shown) may consist of a steel body of the same outer diameter and length as a sealing assembly but having a connection on an upper end compatible with a lower connection of the drill pipe (not shown) in use. With a simplified running tool (not shown) installed and locked in place, drill pipe (not shown) may be attached to lift riserless marine package 100 using the drilling rig's hoisting system (not shown). Whereas conventional running tools require a flange connection or a specific internal profile and often include many moving parts, the simplified running tool (not shown) of riserless marine package 100 requires no moving parts, requires no external power sources, and allows the entire riserless marine package 100 to be lifted by the latching mechanism (e.g., 800*a* and 800*b* of FIG. 1C).

Figure 3A:
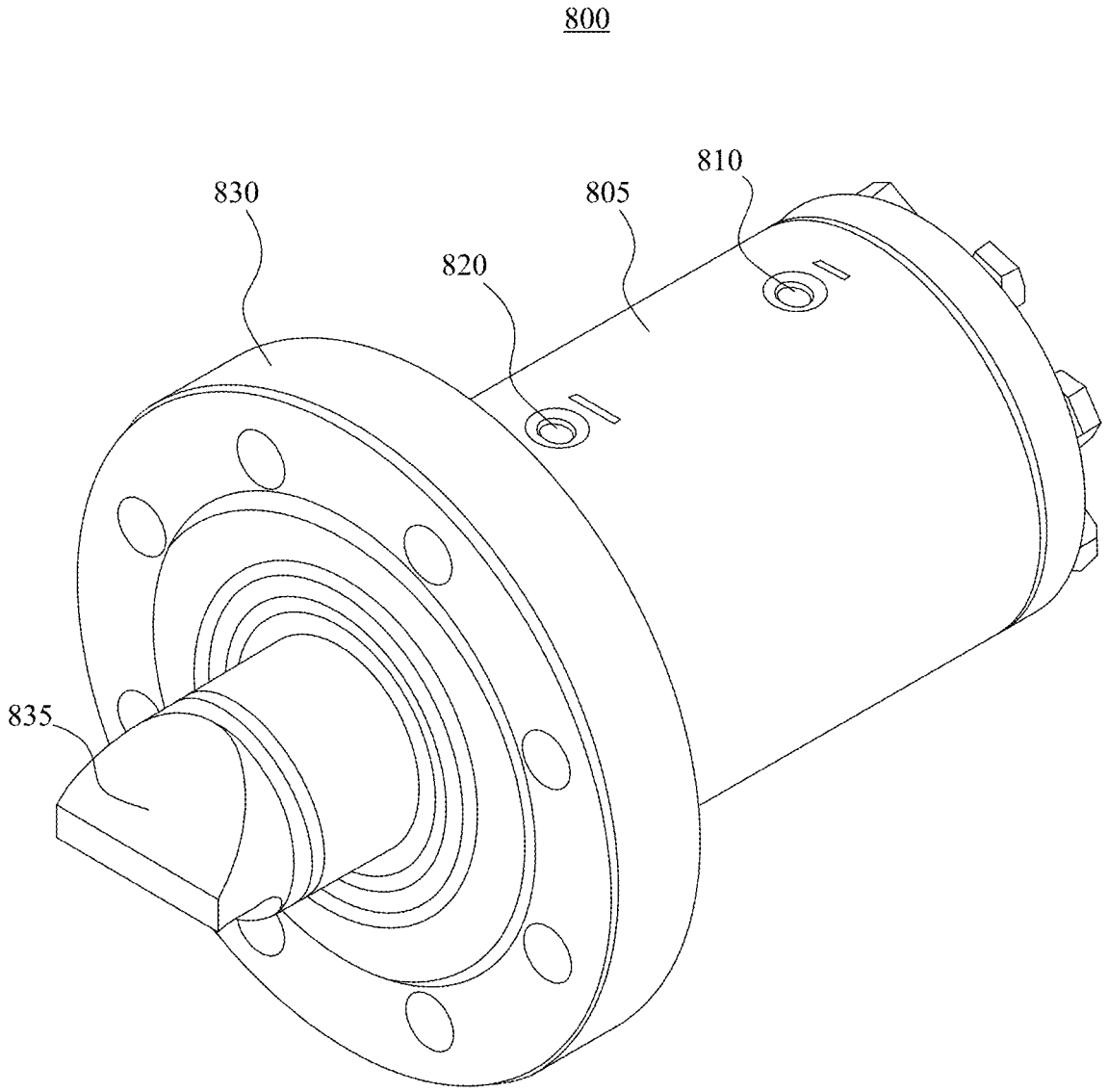
FIG. 3A shows a perspective view of a latching mechanism of a riserless marine package in accordance with one or more embodiments of the present invention.

FIG. 3A shows a perspective view of a latching mechanism 800 of a riserless marine package 100 in accordance with one or more embodiments of the present invention. As previously discussed, riserless marine package 100 includes a central bore (e.g., 110 of FIG. 1C) having an inner diameter (e.g., 120 of FIG. 1C) corresponding to an inner diameter (not shown) of a central bore (not shown) of a subsea BOP (not shown). Latching mechanism 800, sometimes referred to in the industry as a locking dog, is a type of radially actuating latching mechanism that is disposed around the central bore (e.g., 110 of FIG. 1C) of riserless marine package 100. Latching mechanism 800 includes a housing 805, an actuating port 810, an actuating chamber (e.g., 815 of FIG. 3B), a release port 820, a release chamber (e.g., 825 of FIG. 3B), a mounting flange 830, and an extendable and retractable locking dog 835.

In the retracted state, locking dog 835 does not extend into the central bore (e.g., 110 of FIG. 1C) of riserless marine package 100. In the actuated state, locking dog 835 extends into the central bore (e.g., 110 of FIG. 1C) of riserless marine package 100, providing a temporary landing shoulder to land, for example, a retrievable sealing element (not shown) or a tool (not shown). For example, a plurality of latching mechanisms (e.g., 800*b* of FIG. 1C) may be disposed around the central bore (e.g., 110 of FIG. 1C) of riserless marine package 100, below the annular packer system (e.g., 410 of FIG. 1C). The locking dogs 835 of the plurality of latching mechanisms (e.g., 800*b* of FIG. 1C) may be actuated and create a temporary shoulder to land a retrievable sealing element (not shown) or a tool (not shown). Then, a plurality of latching mechanisms (e.g., 800*a* of FIG. 1C) may be actuated such that the locking dogs 835 are extended and lock the retrievable sealing element (not shown) or tool (not shown) into place.

Figure 3B:
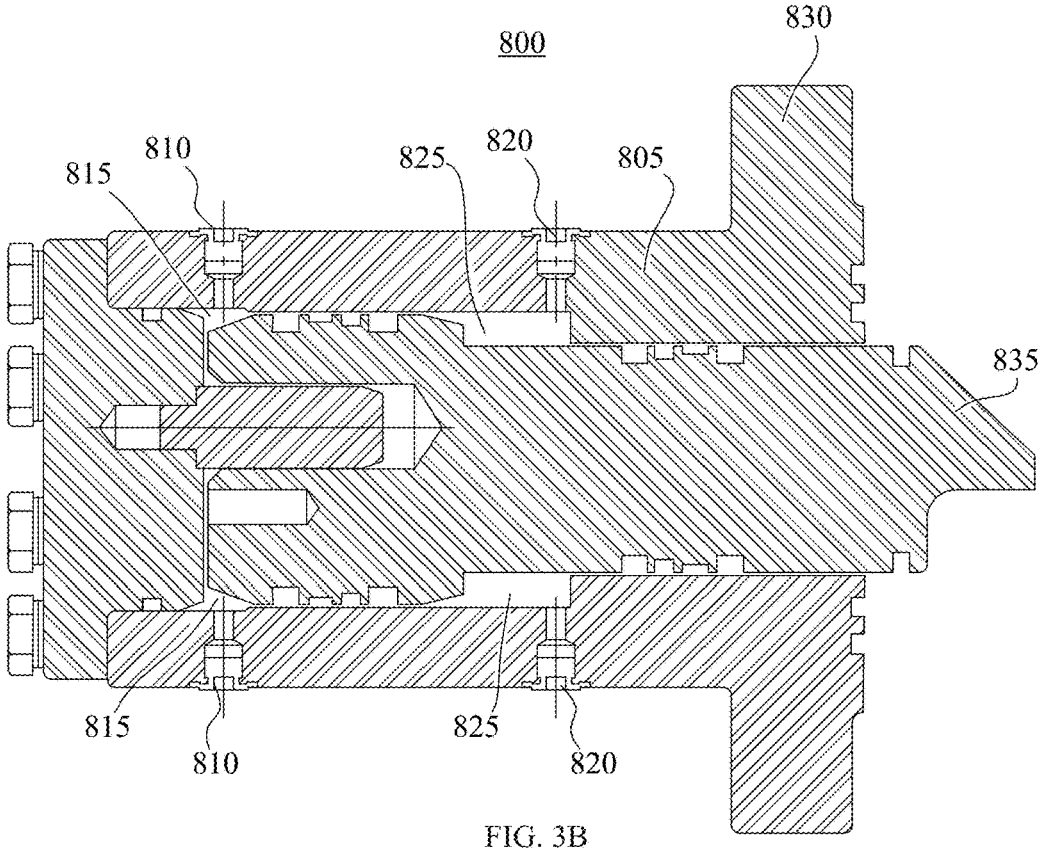
FIG. 3B shows a cross-sectional view of a latching mechanism of a riserless marine package in an unactuated state in accordance with one or more embodiments of the present invention.
Figure 3C:
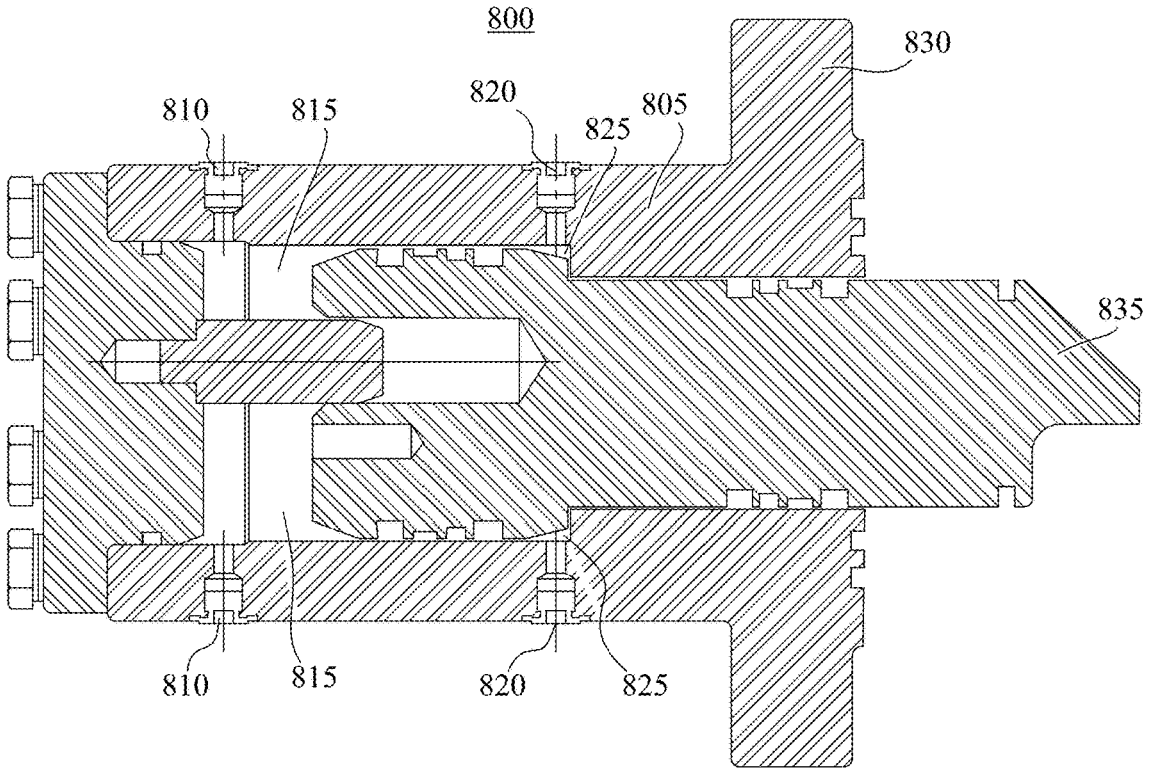
FIG. 3C shows a cross-sectional view of a latching mechanism of a riserless marine package in an actuated state in accordance with one or more embodiments of the present invention.

Continuing, FIG. 3B shows a cross-sectional view of a latching mechanism 800 of a riserless marine package 100 in an unactuated state in accordance with one or more embodiments of the present invention. In the unactuated state, locking dog 835 is in a retracted state and does not extend into the central bore (e.g., 110 of FIG. 1C) of riserless marine package 100. To actuate, hydraulic pressure is applied to actuating chamber 815 via one or more actuating ports 810 and hydraulic pressure is released from release chamber 825 via one or more release ports 820, causes locking dog 835 to extend as shown in FIG. 3C. Continuing, FIG. 3C shows a cross-sectional view of a latching mechanism 800 of a riserless marine package 100 in an actuated state in accordance with one or more embodiments of the present invention. In the actuated state, locking dog 835 is in the extended state and extends into the central bore (e.g., 110 of FIG. 1C) of riserless marine package 100. To retract it, hydraulic pressure is applied to release chamber 825 via one or more release ports 820 and hydraulic pressure is released from actuating chamber 815 via one or more actuating ports 810, causing locking dog 835 to retract as shown in FIG. 3B.

Figure 4:
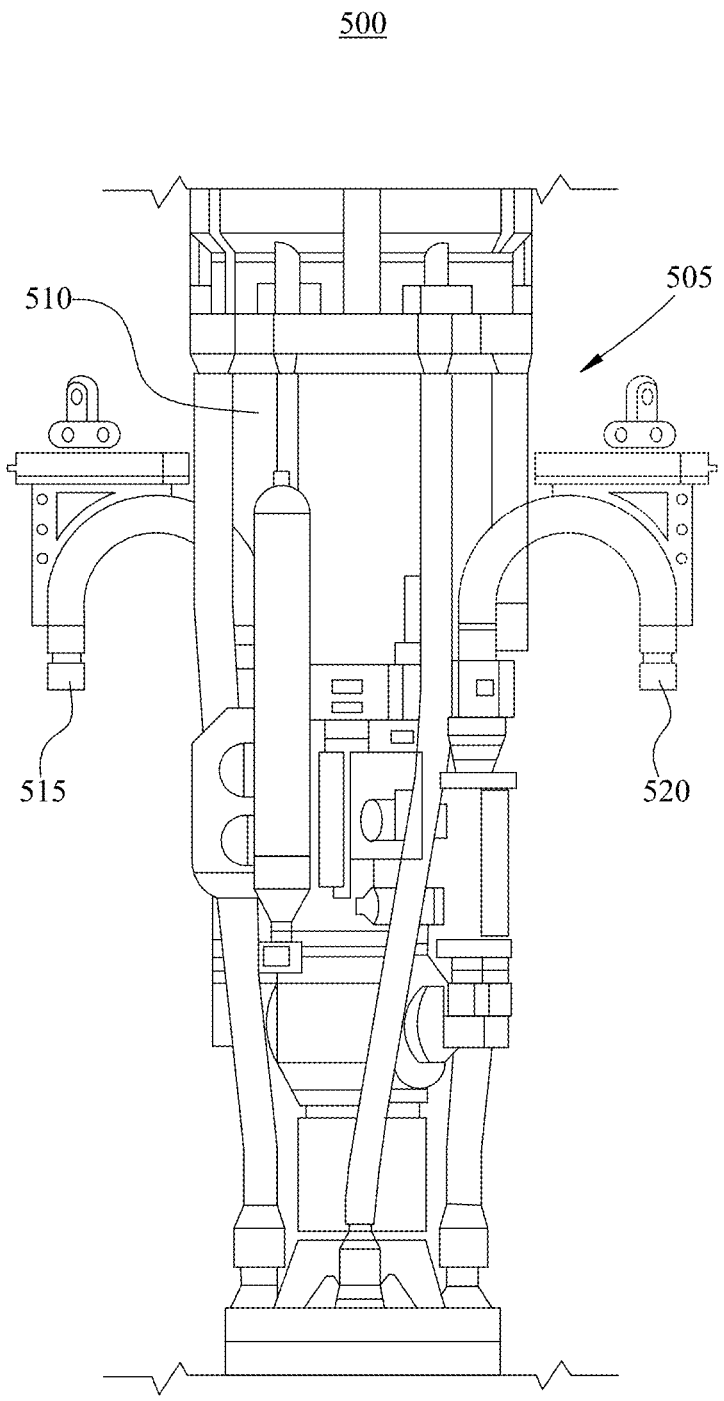
FIG. 4 shows a buffer chamber of a riserless marine package in accordance with one or more embodiments of the present invention.

FIG. 4 shows a buffer chamber 500 of a riserless marine package 100 in accordance with one or more embodiments of the present invention. Buffer chamber 500 may be disposed directly below multi-purpose annular packer and latching mechanism 400 and directly above the lower seal group (e.g., 600 of FIG. 1A). Buffer chamber 500 provides margin for leakage of drilling fluid from the lower seal group (e.g., 600 of FIG. 1A).

Buffer chamber 500 may include a housing portion 505 that may be a discrete component that is combined with other components to form the larger housing structure (e.g., 300 of FIG. 1A) of riserless marine package 100 or part of a singular integrated housing structure (not shown) of riserless marine package 100. Buffer chamber 500 may also include a chamber area 510, a fluid injection port 515, and a fluid return port 520. Chamber area 510 may include a central bore (not shown) having an inner diameter (not shown) at least as large as the smallest inner diameter of any other component disposed within the central bore (e.g., 110 of FIG. 1C) of riserless marine package 100. In certain embodiments, chamber area 510 may include a central bore (not shown) having an inner diameter (not shown) that is substantially larger (not shown) than any other component disposed within the central bore (e.g., 110 of FIG. 1C) of riserless marine package 100.

When tripping a drill string (not shown) or casing string (not shown) into the well, fluid volume may be displaced by the drill string (not shown) or casing string (not shown). During tripping in, a lifting pump (not shown) may be used to prevent displaced fluid from being lost to the environment. Buffer chamber 500 may include an internal seawater jetting system (not shown) fluidly connected a seawater pump (not shown). When tripping a drill string (not shown) out of the well, seawater jetting may be used to clean material off the outer surface of the drill string (not shown). Simultaneously, fluid and debris may be drawn into a suction line (not shown) fluidly connected the returns manifold (not shown) and lifted to the surface in a volume-controlled manner where each gallon of fluid injected into buffer chamber 500 is offset by a gallon of fluid removed from buffer chamber 500.

Buffer chamber 500 may include one or more sensors (not shown) disposed within chamber area 510 that convey information regarding the fluid contained within chamber area 510. In certain embodiments, a differential pressure sensor (not shown) may be used to describe average fluid density of the fluid in chamber area 510. In other embodiments, a plurality of differential pressure sensors (not shown) may be used to describe average fluid density of the fluid in chamber area 510, at different elevations. In such an embodiment, a reading indicating that drilling fluid (not shown) has reached a first higher level (not shown) within chamber area 510 triggers the temporary operation of a lifting pump (not shown) until the drilling fluid has reached a second lower level (not shown) within chamber area 510. In other embodiments, fluid from chamber area 510 may be continuously sampled using a sampling loop and subsea metering system (not shown) which draws fluid from chamber area 510 into a pump (not shown) which sends it through a meter (not shown), then back to chamber area 510. Readings from the sampling loop indicating high drilling fluid content or other contamination may trigger the temporary operation of a lifting pump (not shown) until fluid in chamber area 510 is sufficiently clean. In still other embodiments, a suction line (not shown) may be fluidly connected to a lifting pump (not shown) that draws fluid from below the lower sealing group (e.g., 600 of FIG. 1A) emptying chamber area 510.

Figure 5A:
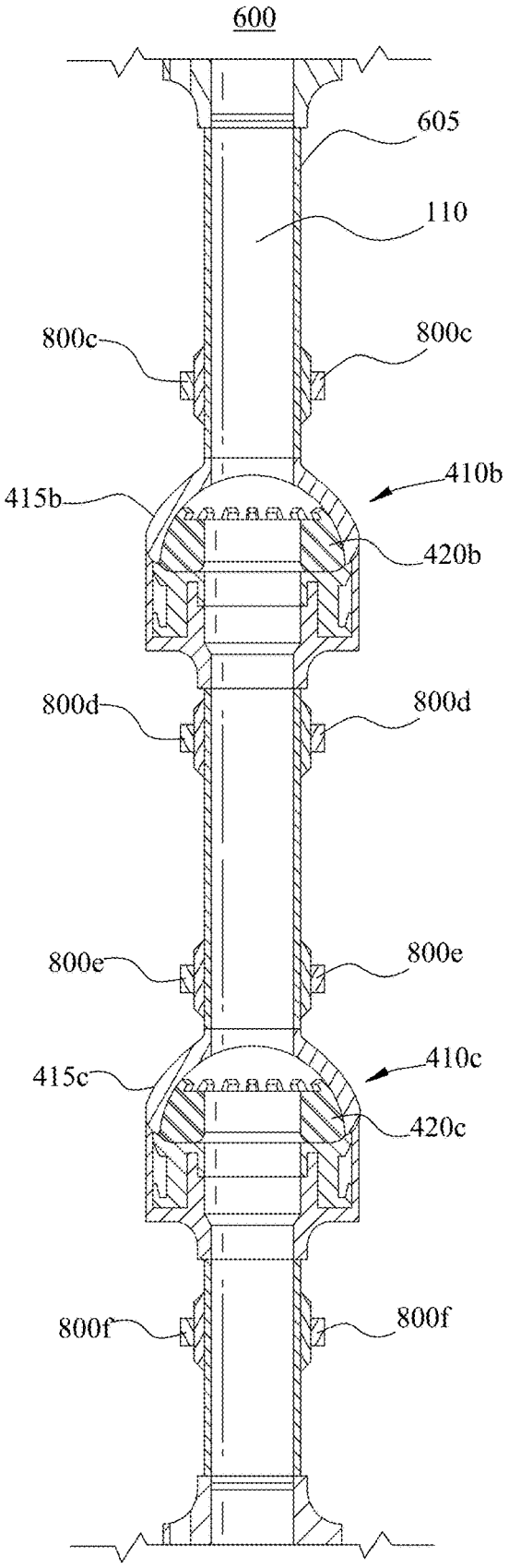
FIG. 5A shows a cross-sectional view of a lower seal group of a riserless marine package in accordance with one or more embodiments of the present invention.

FIG. 5A shows a cross-sectional view of a lower seal group 600 of a riserless marine package 100 in accordance with one or more embodiments of the present invention. Lower seal group 600 may be disposed directly below the buffer chamber (e.g., 500 of FIG. 1A). Lower seal group 600 may provide flexibility and redundancy in sealing the annulus (not shown) and preventing the upward flow of returning fluids from the wellbore annulus (not shown). Lower seal group 600 may include a housing portion 605 that may be a discrete component that is combined with other components to form the larger housing structure (e.g., 300 of FIG. 1A) of riserless marine package 100 or part of a singular integrated housing structure (not shown) of riserless marine package 100.

Lower seal group 600 may include an upper annular packer 410*b*, a second upper latching mechanism 800*c* disposed above upper annular packer 410*b*, and a second lower latching mechanism 800*d* disposed below upper annular packer 410*b*. Lower seal group may also include a lower annular packer 410*c*, disposed below upper annular packer 410*b*, a third upper latching mechanism 800*e* disposed above lower annular packer 410*c*, and a third lower latching mechanism 800*f* disposed below lower annular packer 410*c*. Lower seal group 600 may include a central bore 110 having an inner diameter that corresponds to the inner diameter (e.g., 120 of FIG. 1C) of the central bore (e.g., 110 of FIG. 1C) of riserless marine package 100 (and the subsea BOP).

Lower seal group 600 may use any combination of active sealing elements, passive sealing elements, or no sealing elements, relying instead on packers 420*b* or 420*c*. In certain embodiments, lower seal group 600 may use an active sealing element (not shown) disposed within upper annular packer 410*b* and an active sealing element (not shown) disposed within lower annular packer 410*c*. In other embodiments, lower seal group 600 may use an active sealing element (not shown) disposed within upper annular packer 410*b* and a passive sealing element (not shown) disposed within lower annular packer 410*c*. In still other embodiments, lower seal group 600 may use a passive sealing element (not shown) disposed within upper annular packer 410*b* and an active sealing element (not shown) disposed within lower annular packer 410*c*. In still other embodiments, lower seal group 600 may use a passive sealing element (not shown) disposed within upper annular packer 410*b* and a passive sealing element (not shown) disposed within lower annular packer 410*c*.

Figure 5B:
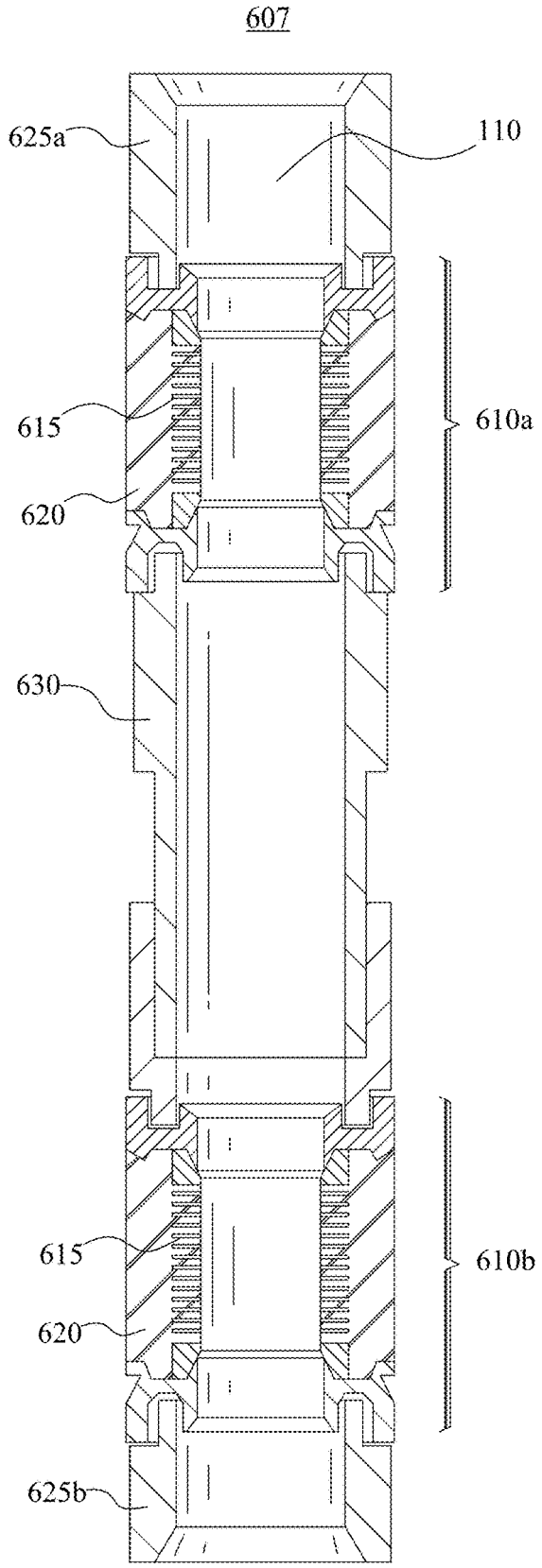
FIG. 5B shows a cross-sectional view of a non-rotating ACD dual seal sleeve assembly of a lower seal group of a riserless marine package in accordance with one or more embodiments of the present invention.

Continuing, FIG. 5B shows a cross-sectional view of a non-rotating ACD dual seal sleeve 607 of lower seal group 600 of riserless marine package 100 in accordance with one or more embodiments of the present invention. In certain embodiments, lower seal group 600 may use an active sealing element (not shown) disposed within upper annular packer 410*b* and an active sealing element (not shown) disposed within lower annular packer 410*c*. In such embodiments, a non-rotating ACD dual seal sleeve 607 may be used. Non-rotating ACD dual seal sleeve 607 may include an upper mandrel 625*a*, an upper sealing element 610*a*, a spacer mandrel 630, a lower sealing element 610*b*, and a lower mandrel 625*b*. Each of upper sealing element 610*a* and 610*b* may include a PTFE insert 615 co-molded with a polyurethan buffer material 620. Mandrels 625*a*, 630, and 625*b* may include a central bore through which tubular members (not shown) or tools (not shown) may be disposed therethrough or fluids (not shown) may flow through.

Figure 5C:
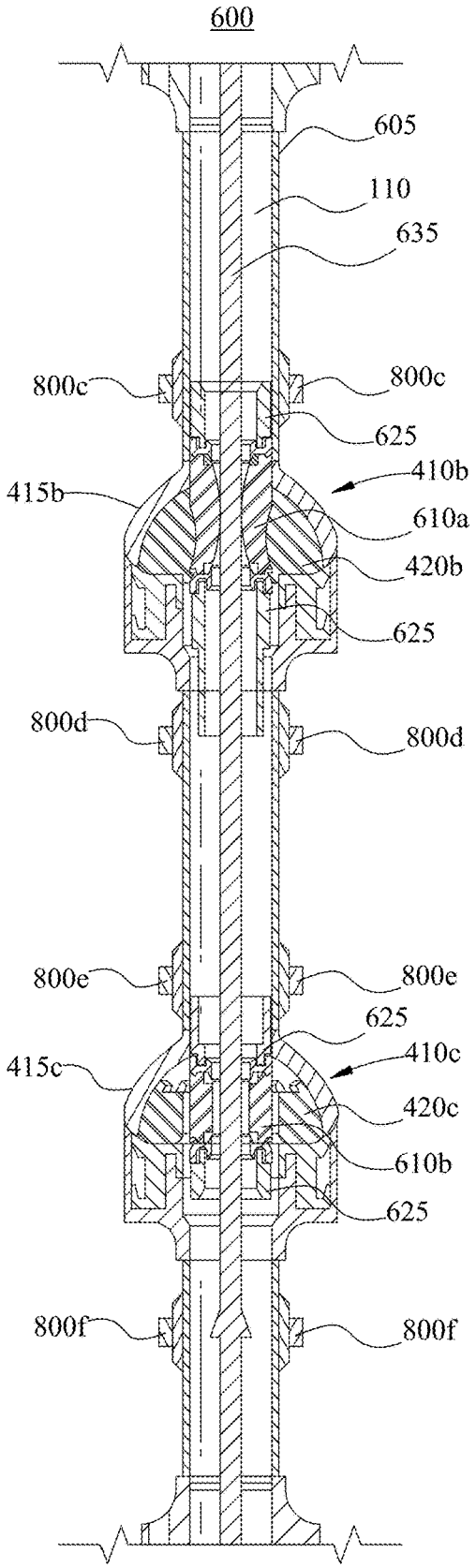
FIG. 5C shows a cross-sectional view of a lower seal group of a riserless marine package with non-rotating ACD seal sleeves installed in accordance with one or more embodiments of the present invention.

Continuing, FIG. 5C shows a cross-sectional view of lower seal group 600 of a riserless marine package 100 with non-rotating ACD seal sleeves installed in accordance with one or more embodiments of the present invention. While the non-rotating ACD dual seal sleeve (607 of FIG. 5B) includes two active sealing elements on a mandrel, each of active sealing element 610*a* and active sealing element 610*b* may be run in and out independently on their own mandrels 625. This allows one active sealing element to be disengaged while another active sealing element remains in place to maintain the wellbore seal. This technique may be employed to sequence the sealing elements 610*a*, 610*b* to extend the time frame during which the annular seal can be maintained or to enable maintenance operations on one while sealing on the other. In the example depicted in the figure, upper sealing element 610*a* is shown in an engaged state, where upper annular packer 420*b* engaged upper sealing element 610*a* forming an interference fit with tubular member 635 while lower annular packer 420*c* is not engaged and lower sealing element 610*b* does not make contact with tubular member 635.

Figure 5D:
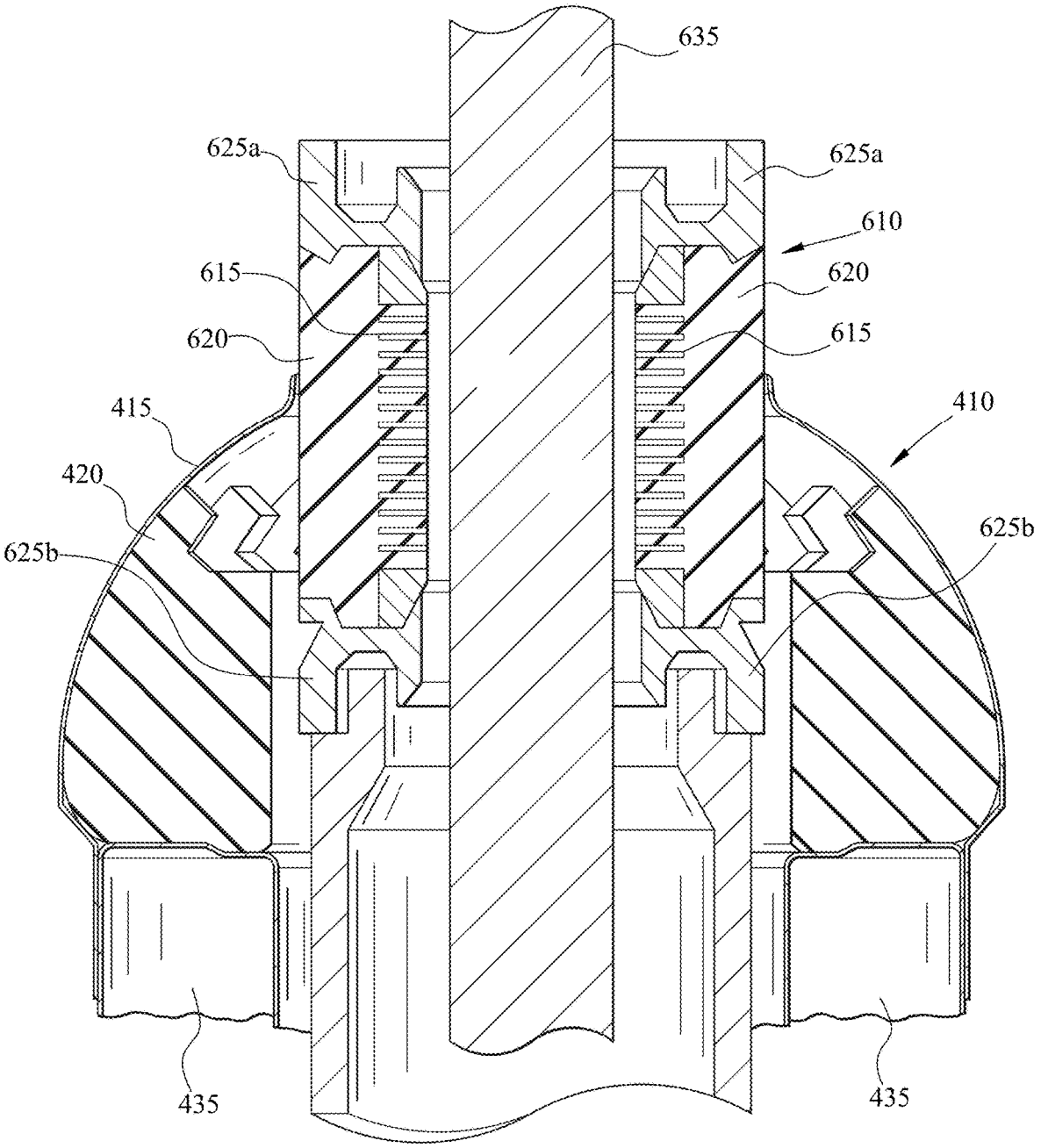
FIG. 5D shows a cross-sectional detailed view of an annular packer and active sealing element of a lower seal group in a disengaged state in accordance with one or more embodiments of the present invention.

Continuing, FIG. 5D shows a cross-sectional detailed view of an annular packer 410 and active sealing element 610 of lower seal group 600 in a disengaged state in accordance with one or more embodiments of the present invention. As previously discussed, each sealing element (e.g., 610) of lower seal group 600 may be run into annular packer 410 independently of one another. Typically, a plurality of lower latching mechanisms (e.g., 800*d* or 800*f* of FIG. 1C) may be engaged to create a landing shoulder on which the active sealing element 610 on mandrel 625 is run into annular packer 410. Once in place, a plurality of upper latching mechanisms (e.g., 800*c* or 800*e* of FIG. 1C) may be engaged to secure active sealing element 610 in place.

Figure 5E:
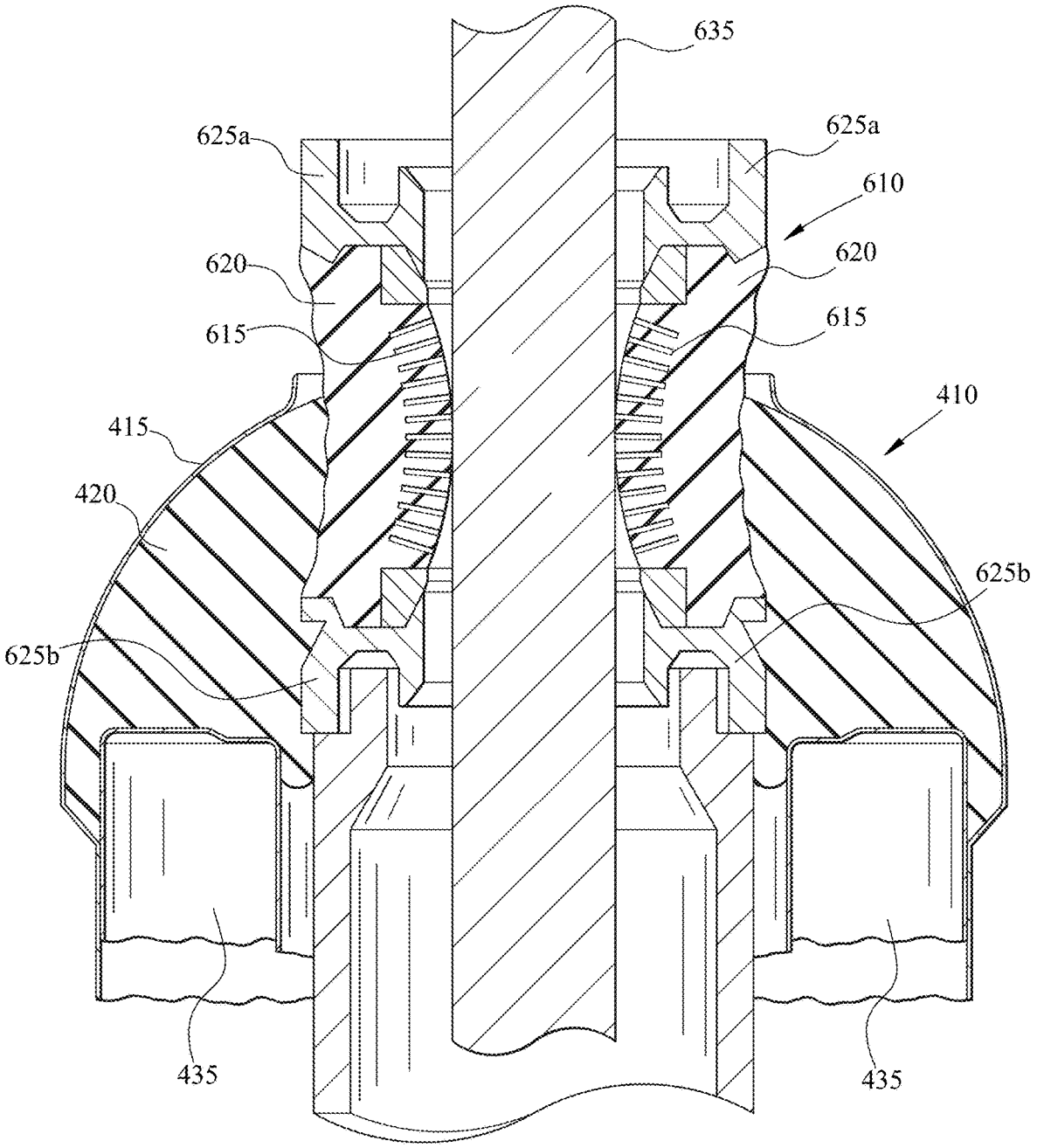
FIG. 5E shows a cross-sectional detailed view of an annular packer and active sealing element of a lower seal group in an engaged state in accordance with one or more embodiments of the present invention.

Continuing, FIG. 5E shows a cross-sectional detailed view of an annular packer 410 and active sealing element 610 of lower seal group 600 in an engaged state in accordance with one or more embodiments of the present invention. A piston-actuated hydraulic control system (not shown) may controllably, and to the degree desired, actuate a piston 435 that causes annular packer member 420 to travel within housing portion 415 and cause active sealing element 610 to flex such that the deflected portion forms an interference fit with tubular member 430 or any other or irregularly shaped members disposed therethrough. The degree to which annular packer member 420 travels depends on the amount of closing pressure applied by the piston-actuated hydraulic control system (not shown).

While lower seal group 600 may use any combination of active and passive sealing elements, the use of two active sealing elements enables the sequential operation of the sealing elements with staged actuation. While passive sealing elements form an interference fit from the moment a tubular member is disposed therethrough, active sealing elements are run in in a relaxed state. Each active sealing element may be engaged independently of one another; thus the active sealing elements may be used one at a time, extending the life a seal assembly may be used before replacement.

Figure 6:
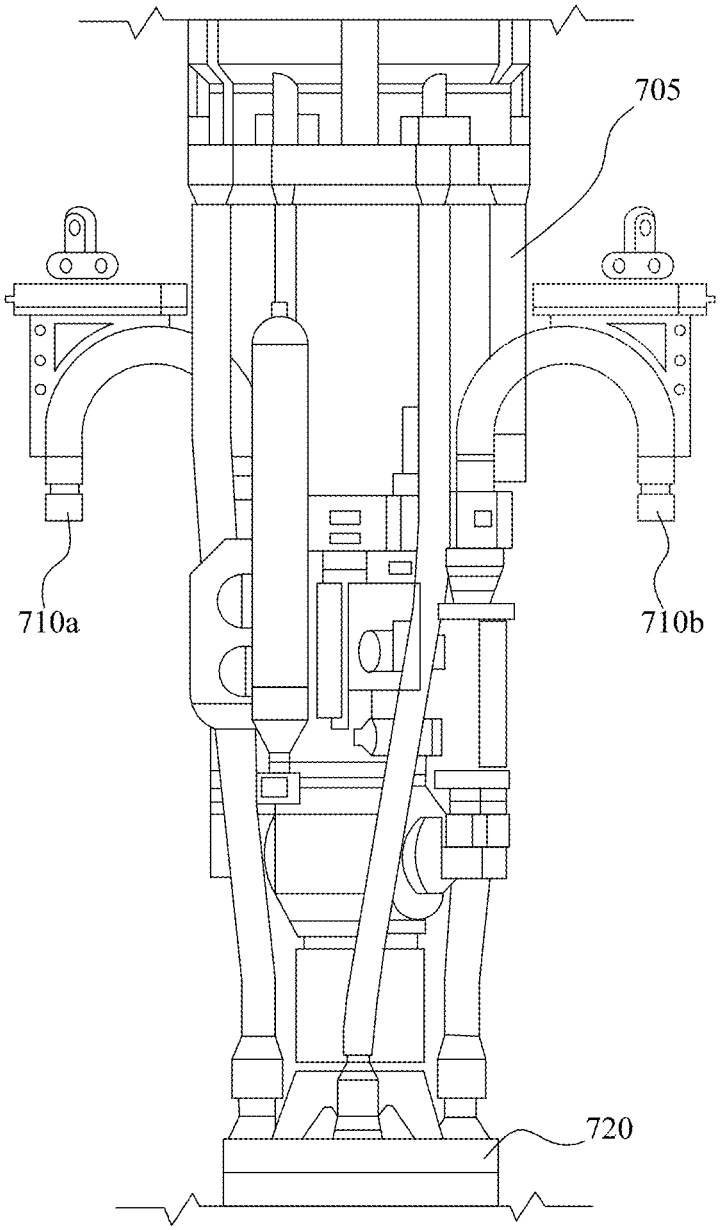
FIG. 6 shows an annular fluid return port of a riserless marine package in accordance with one or more embodiments of the present invention.

FIG. 6 shows an annular fluid return port 700 of a riserless marine package 100 in accordance with one or more embodiments of the present invention. Annular fluid return port 700 may be disposed directly below the lower seal group (e.g., 600 of FIG. 1A) that creates an annular seal (not shown). As such, annular fluid return port 700 may be used to divert returning fluids and prevent them from flowing upward through the central bore (e.g., 110 of FIG. 1C), beyond annular fluid port 700. Goosenecks 710*a* and 710*b* may be used to fluidly connect annular fluid return port 700 to a returns manifold (not shown). Annular fluid return port 700 may include a lower connection end 720 that may be removably attached to an upper connection end (not shown) of a subsea BOP using any conventional connection used between a conventional LMRP and a conventional subsea BOP. In this instance, lower connection end 720 of annular fluid return port 700 would connect in place of a conventional LMRP.

Figure 7:
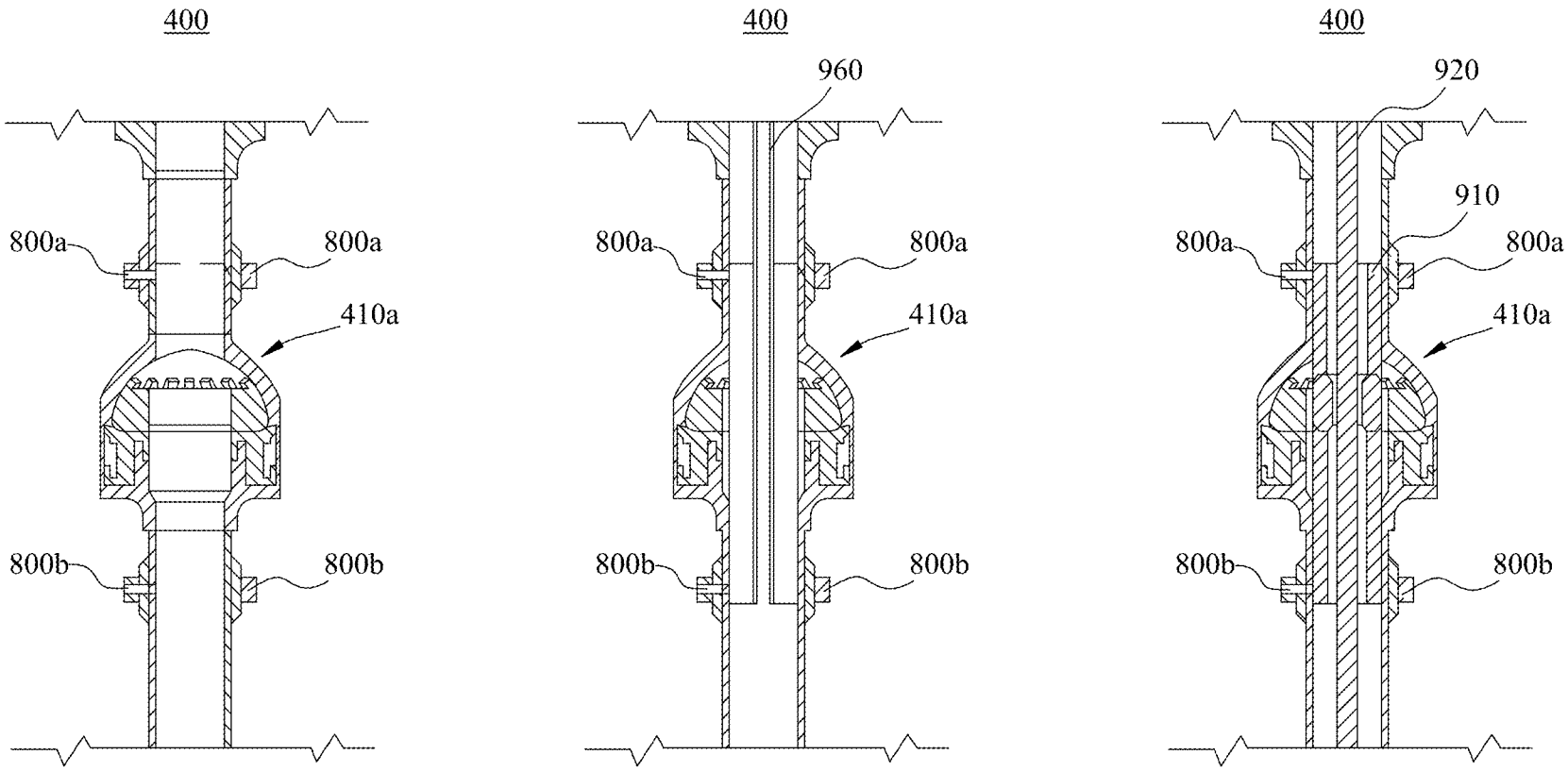
FIG. 7 shows a running tool used to deploy a riserless marine package in accordance with one or more embodiments of the present invention.

FIG. 7 shows a running tool 910 used to deploy a riserless marine package 100 in accordance with one or more embodiments of the present invention. Due to the height of the combined riserless marine package 100 and subsea BOP (not shown) stack and the height limitations within the moon pool of a contemporary drilling rig (not shown), the riserless marine package 100 and subsea BOP (not shown) may be run in separately. The subsea BOP (not shown) may be run in first using a dedicated running tool (not shown) disposed at the end of a drill pipe string (not shown). The subsea BOP (not shown) may be lowered to the seafloor and latched to the wellhead (not shown) using an ROV (not shown). Once the subsea BOP (not shown) is latched onto the wellhead (not shown), a simplified running tool 910, with no moving parts, may be run into multi-purpose annular packer and latching mechanism 400 of riserless marine package 100. A plurality of lower latching mechanisms 800*b* may be engaged creating a landing shoulder. Running tool 910 may be landed on the plurality of lower latching mechanisms 800*b*. Then a plurality of upper latching mechanisms 800*a* may be engaged to secure running tool 910 in place. The upper distal end of running tool 910 may include a connection end configured to connect to drill pipe 920, such that drill pipe 920 may be used to pick up riserless marine package 100, lower it through the sea, and land it on the subsea BOP (not shown) and secured in place.

Figure 8:
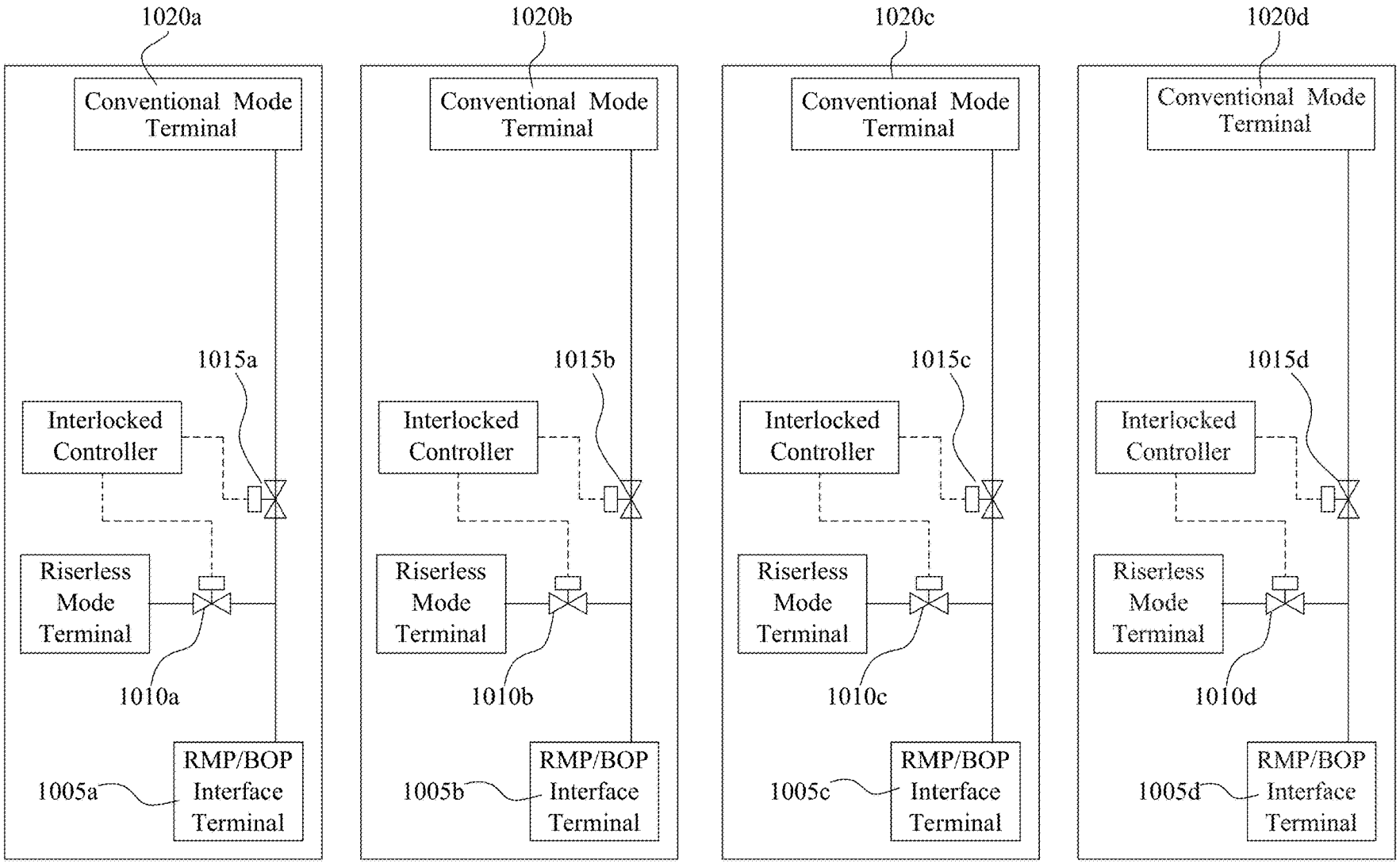
FIG. 8 shows a schematic of configurable auxiliary line connections for dual operating modes of a riserless marine package in accordance with one or more embodiments of the present invention.

FIG. 8 shows a schematic of configurable auxiliary line connections for dual operating modes of a riserless marine package 100 in accordance with one or more embodiments of the present invention. Riserless marine package 100 may include one or more manifolds for configurable auxiliary line connections to enable both post-BOP riserless drilling mode and a conventional drilling mode using a marine riser (not shown). Advantageously, riserless marine package 100 provides configurable auxiliary connections for both operating modes, thereby enabling secondary well control operations in both operating modes.

In riserless drilling mode, a subsea choke line gooseneck (not shown) for the choke auxiliary line function may be fluidly connected to a corresponding termination point at the RMP/BOP interface terminal 1005*a* by way of a choke mode selection valve or valve manifold 1010*a*. From the subsea BOP, fluid within the choke line flows from the termination point at the RMP/BOP interface terminal 1005*a* through the choke mode selection valve or valve manifold 1010*a*. In riserless drilling mode, the flow path toward a termination assembly 1020*a* is blocked 1015*a* while the flow path toward the choke line gooseneck is open 1010*a*. Fluid flows through the subsea choke line gooseneck (not shown) to a separate offset return line (not shown) connected to the drilling rig (not shown). In conventional drilling mode, the flow path toward a termination assembly 1020*a* is open 1015*a* while the flow path toward the subsea choke line gooseneck (not shown) is blocked 1010*a*.

In riserless drilling mode, a subsea kill line gooseneck (not shown) for the kill auxiliary line function may be fluidly connected to a corresponding termination point at the RMP/BOP interface terminal 1005*b* by way of a kill mode selection valve or valve manifold 1010*b*. From the drilling rig (not shown), kill fluid within the kill line flows through the subsea kill line gooseneck (not shown) toward the kill mode selection valve or valve manifold 1010*b*. In riserless drilling mode, the flow path toward a termination assembly 1020*b* is blocked 1015*b* while the flow path toward the termination point at the RMP/BOP interface 1005*b* is open 1010*a*. In conventional drilling mode, the flow path from a termination assembly 1020*b* is open 1015*a* while the flow path toward the subsea kill line gooseneck (not shown) is blocked 1010*b*.

In riserless drilling mode, a subsea hydraulic line gooseneck (not shown) for the hydraulic auxiliary line function may be fluidly connected to corresponding termination point on the RMP/BOP interface terminal 1005*c* by way of a hydraulic mode selection valve or valve manifold 1010*c*. Hydraulic fluid from the drilling rig (not shown) flows through the subsea hydraulic line gooseneck (not shown) toward the hydraulic mode selection valve or valve manifold 1010*c*. In riserless drilling mode, the flow path toward a termination assembly 1020*c* is blocked while the flow path toward the termination point on the RMP/BOP interface terminal 1005*c* is open 1010*c*. In conventional drilling mode, the flow path from a termination assembly 1020*c* is open 1015*c* while the flow path toward the subsea hydraulic line gooseneck (not shown) is blocked 1010*c*.

Drilling in riserless drilling mode simplifies several aspects of a drilling operation. With an optimally sized drilling return line, high annular velocity is maintained at a lower flow rate, reducing, or eliminating the need to boost the return riser to lift cuttings. In certain embodiments, riserless marine package 100 may include a subsea boost line gooseneck (not shown). If a boost line is present in an offset riser (not shown), a boost mode selection valve or valve manifold 1010*d* may be used in combination with a lifting pump (not shown) to lift returns from the buffer chamber (e.g., 500 of FIG. 1A) through the boost line separately from the drilling returns to prevent diluting the return mud. If no boost line is present, then all boost line valves 1010*d* and 1015*d* are closed. In conventional drilling mode, the flow path from a termination assembly 1020*d* is open 1015*d* while the flow path toward the subsea boost line gooseneck (not shown) is blocked 1010*d*. In other embodiments, riserless marine package 100 may not include a boost line gooseneck attachment. In riserless drilling mode, all boost line valves 1010*d* and 1015*d* are closed. In conventional mode, the flow path from a termination assembly 1020*d* is open 1015*d* enabling normal flow of boost mud.

Figure 9A:
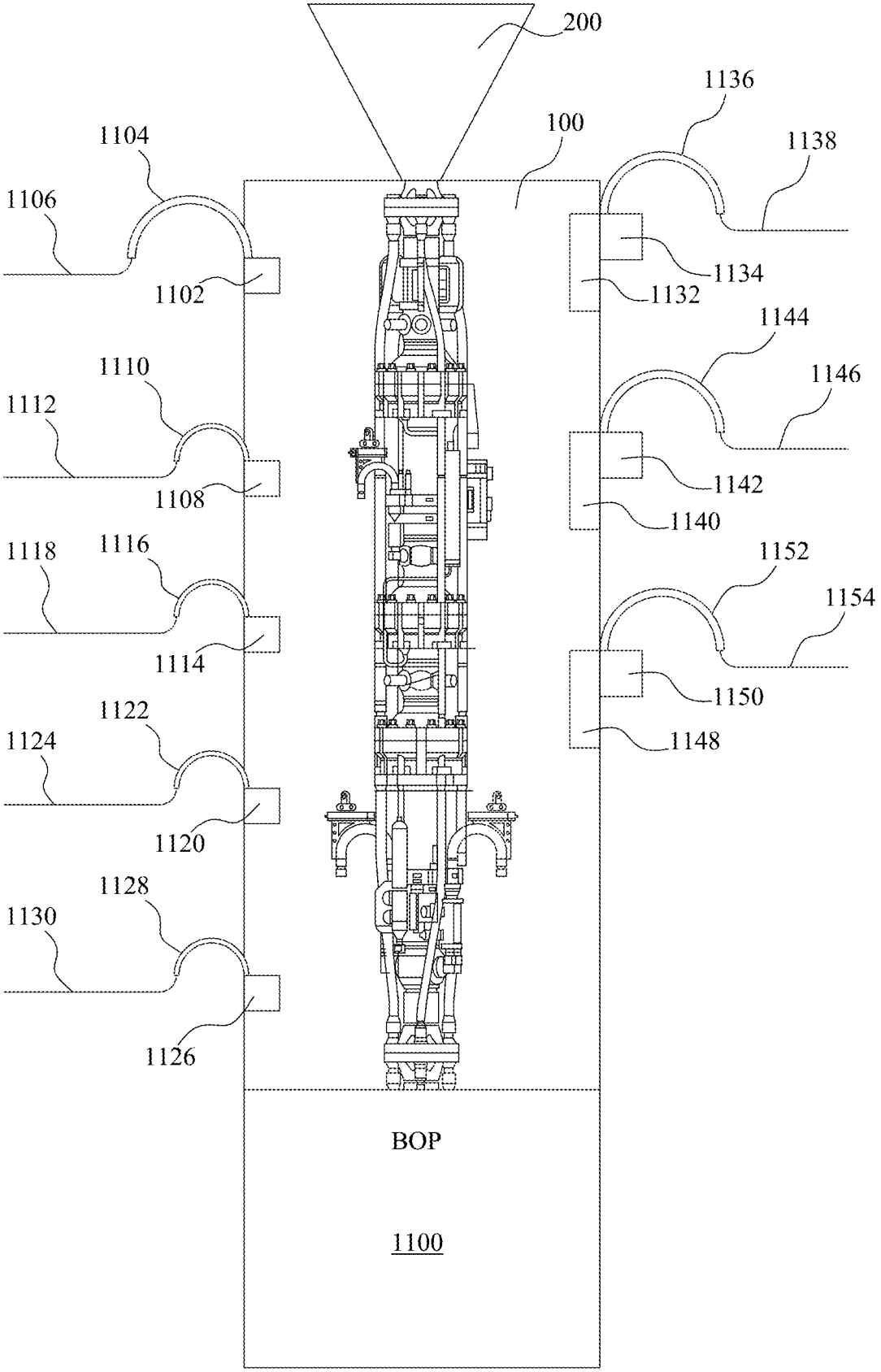
FIG. 9A shows a subsea BOP and riserless marine package with a removably attached input guide for riserless drilling operations in accordance with one or more embodiments of the present invention.

FIG. 9A shows a subsea BOP 1100 and riserless marine package 100 with a removably attached input guide 200 for riserless drilling operations in accordance with one or more embodiments of the present invention. Riserless marine package 100 may include a mud return line riserless mode terminal 1102, a mud return line hose attachment 1104, and a flexible mud return line hose 1106. Riserless marine package 100 may also include a kill line riserless mode terminal 1108, a kill line hose attachment 1110, and a flexible kill line hose 1112. Riserless marine package 100 may also include a choke line riserless mode terminal 1114, a choke line hose attachment 1116, and a flexible choke line hose 1118. Riserless marine package 100 may also include a boost line riserless mode terminal 1120, a boost line hose attachment 1122, and a flexible boost line hose 1124. Riserless marine package 100 may also include a hydraulic line riserless mode terminal 1126, a hydraulic line hose attachment 1128, and a flexible hydraulic line hose 1310. Riserless marine package 100 may also include an RMP pod/umbilical terminal 1132, an RMP umbilical termination head 1134, an RMP umbilical support 1136, and an RMP umbilical 1138. Riserless marine package 100 may also include a BOP blue pod/umbilical terminal 1140, a BOP umbilical termination head 1142, a BOP umbilical support 1144, and a BOP umbilical 1146. Riserless marine package 100 may also include a BOP yellow pod/umbilical terminal 1148, a BOP umbilical termination head 1150, an BOP umbilical support 1152, and a BOP umbilical 1154. One of ordinary skill in the art will recognize that this is merely exemplary of a way in which such connections could be made, and the type and kind of connections may vary based on an application or design in accordance with one or more embodiments of the present invention.

Figure 9B:
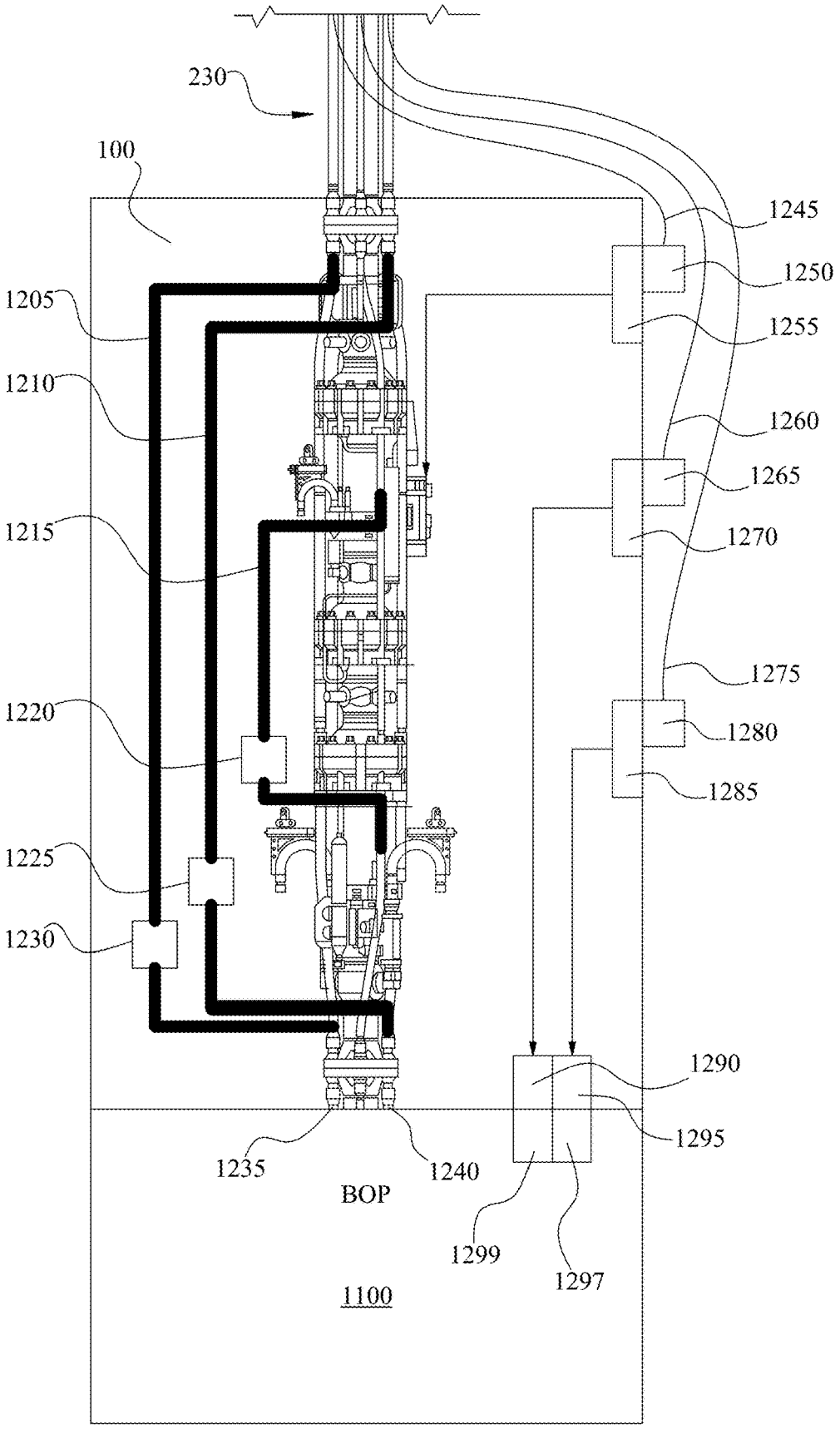
FIG. 9B shows a subsea BOP and riserless marine package with a removably attached riser termination assembly for conventional riser drilling operations in accordance with one or more embodiments of the present invention.

Continuing, FIG. 9B shows a subsea BOP 1100 and riserless marine package 100 with a removably attached riser termination assembly 230 for conventional riser drilling operations in accordance with one or more embodiments of the present invention. Riserless marine package 100 may include a kill line 1205 lined up to riser termination assembly 230, a choke line 1210 lined up to riser termination assembly 230, and a hydraulic line 1215 lined up to riser termination assembly 230. Riserless marine package 100 may also include a configurable hydraulic line manifold 1220, a configurable choke line manifold 1225, and a configurable kill line manifold 1230. Riserless marine package 100 may also include an RMP umbilical 1245, an RMP umbilical termination head 1250, and an RMP pod/umbilical terminal 1255. Riserless marine package 100 may also include a BOP blue umbilical 1260, a BOP umbilical termination head 1265, and a BOP blue pod/umbilical terminal 1270. Riserless marine package 100 may also include a BOP yellow umbilical 1275, a BOP umbilical termination head 1280, and a BOP yellow pod/umbilical terminal 1285. Riserless marine package 100 may also include a blue pod terminal 1290 that connects to a blue pod terminal 1299 on subsea BOP 1100 and a yellow pod terminal 1295 that connects to a yellow pod terminal 1297 on subsea BOP 1100. One of ordinary skill in the art will recognize that this is merely exemplary of a way in which such connections could be made, and the type and kind of connections may vary based on an application or design in accordance with one or more embodiments of the present invention.

Figure 10:
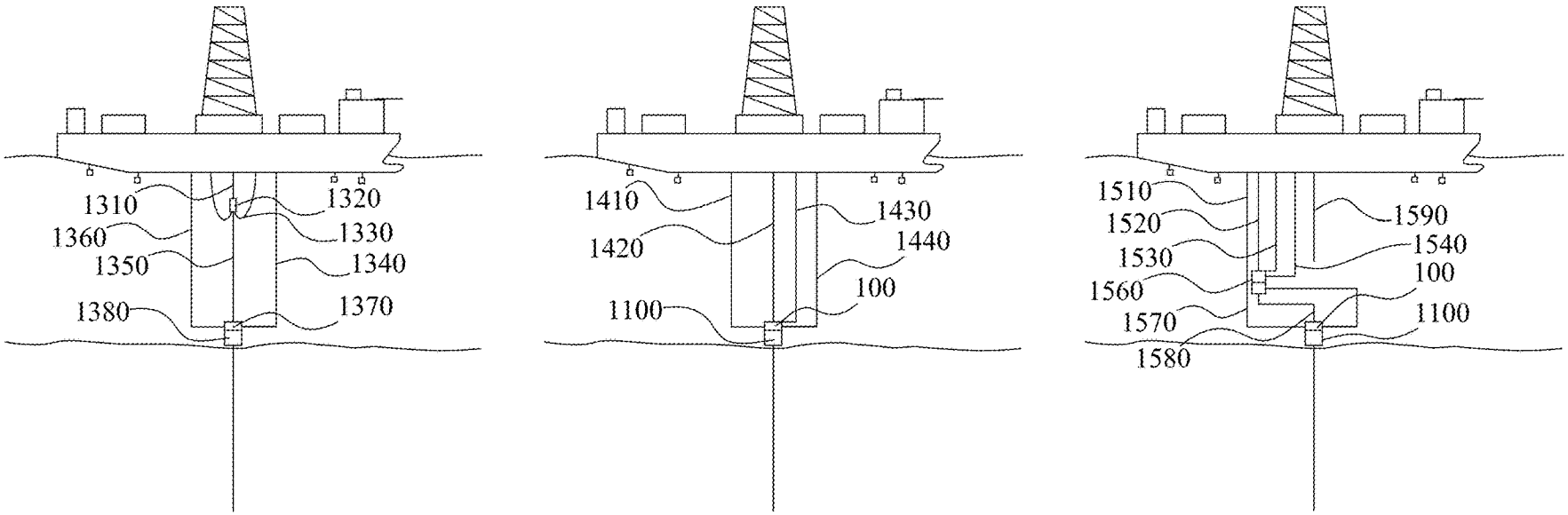
FIG. 10 shows existing subsea umbilical connection options for conventional LMRP with marine riser configuration and riserless marine package with conventional marine riser configuration and riserless marine package with offset riser configuration in accordance with one or more embodiments of the present invention.

FIG. 10 shows existing subsea umbilical connection options for conventional LMRP with marine riser configuration and riserless marine package 100 with conventional marine riser configuration and riserless marine package 100 with offset riser configuration in accordance with one or more embodiments of the present invention.

In a conventional BOP 1380 with LMRP 1370 and marine riser 1350 configuration, the drilling rig is connected to MPD joint 1320 by an MPD joint umbilical 1310. MPD return flow hoses 1330 divert returning fluids from below the annular within MPD joint 1320 to the drilling rig. A blue umbilical 1340 and a yellow umbilical 1360 each connect equipment on the drilling rig to LMRP 1370.

In a riserless marine package 100 with conventional marine riser 1420 configuration, a riserless marine package 100 is fluidly attached to a subsea BOP 1100 disposed on the seafloor. The drilling rig is connected to riserless marine package 100 by a riserless marine package umbilical 1430. A conventional marine riser 1420 fluidly connects the drilling rig to riserless marine package 100 and subsea BOP 1100. A blue umbilical 1440 and a yellow umbilical 1410 each connect equipment on the drilling rig to riserless marine package 100.

In a riserless marine package 100 with an offset riser 1520 configuration, a riserless marine package 100 is fluidly attached to a subsea BOP 1100 disposed on the seafloor. Drillstring 1590 may be run into the well through open water. A yellow umbilical 1510 connects the drilling rig to emergency disconnect 1560. A riserless marine package umbilical 1530 connects the drilling rig to emergency disconnect 1560. A blue umbilical 1540 connects the drilling rig to emergency disconnect 1560. A yellow umbilical jumper 1570 connects emergency disconnect 1560 to riserless marine package 100. A riserless marine package umbilical jumper 1580 connects emergency disconnect 1560 to riserless marine package 100. One of ordinary skill in the art will recognize that this is merely exemplary of a way in which such connections could be made, and the type and kind of connections may vary based on an application or design in accordance with one or more embodiments of the present invention.

Figure 11:
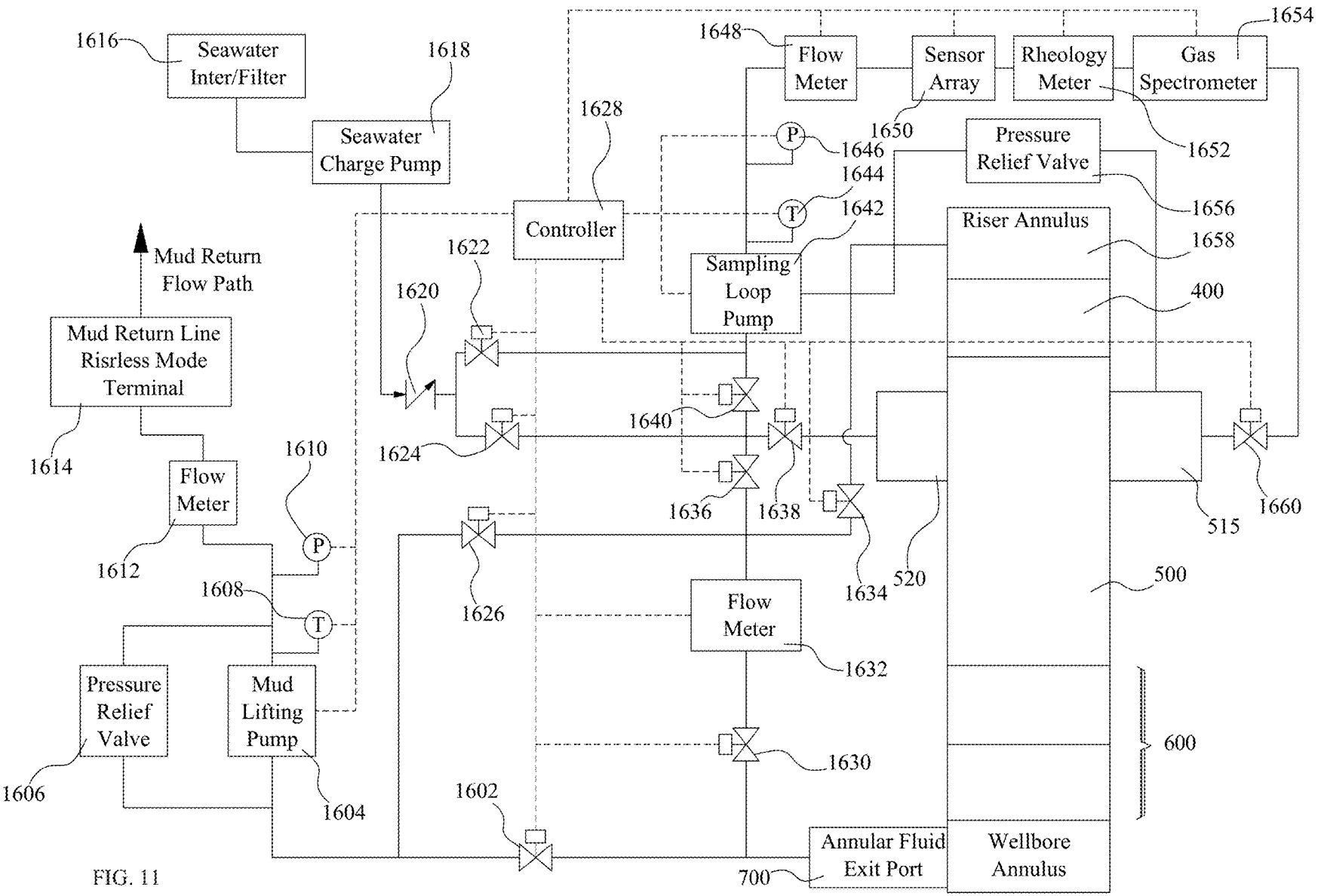
FIG. 11 shows a schematic of a drilling system using a riserless marine package in various possible configurations in accordance with one or more embodiments of the present invention.

FIG. 11 shows a schematic of a drilling system using a riserless marine package 100 in various possible configurations in accordance with one or more embodiments of the present invention.

In one embodiment of the riserless marine package, an integral seawater pump is attached to the riserless marine package lifting frame. The purpose of the seawater pump is to assist in the cleaning of a string during a trip out of the hole which is accomplished by supplying high pressure seawater to spray the outer surface of a drillstring. Seawater is drawn through a filter to prevent seaborne debris from entering the pump. The pump may be of a positive displacement pump type or a kinetic pump type. The pump energizes the seawater. Expected seawater flow rate from the pump may be inferred from the pump shaft rotation rate and/or differential pressure correlations. An optional secondary flow meter may be included to measure the actual seawater flow rate. The secondary flow meter may be a Coriolis flow meter in some applications. However, since the composition of seawater does not change as drastically as the composition of drilling fluid changes, the secondary flow meter may also be of a simpler type, such as a magnetic flow meter or an acoustic flow meter. Readings for expected and measured flow may be transmitted electronically to the surface or processed on a subsea system and used by other components on the riserless marine package.

In one embodiment of the riserless marine package, an array of seawater injection nozzles are disposed radially around a main bore of a riserless marine package at a first elevation. In one embodiment of the riserless marine package, an array of seawater injection nozzles are disposed radially around a main bore of a riserless marine package at various elevations. In one embodiment of the riserless marine package, an array of seawater injection nozzles are disposed on one or more retractable cylinders disposed radially around a main bore of a riserless marine package. One skilled in the art can derive many configurations of seawater injections nozzles.

In one embodiment of the riserless marine package, a seawater pump is not included. Cleaning of a string during a trip out of the hole is accomplished through mechanical scraping or squeegee action using an elastomer element. Such an elastomer element may consist of a spherical annular packer element, a retrievable seal sleeve element, or a purpose-built retrievable seal insert for wireline or other related well construction activity.

In one embodiment of the riserless marine package, an integral lifting pump and a returns manifold are attached to the riserless marine package lifting frame. The lifting pump may be of a positive displacement pump type or a kinetic pump type. The primary purpose of the lifting pump is to prevent spillage of drilling fluid displaced when tripping a drill string or casing string into the hole. The secondary purpose of the lifting pump is to remove mixed drilling fluid and seawater from the buffer chamber during wash down operations. The purpose of the returns manifold is to direct fluids from the wellbore annulus and buffer chamber annulus to their corresponding flow line.

In one embodiment of the riserless marine package, two or more integral lifting pumps are attached to the riserless marine package lifting frame. A first lifting pump is used to prevent spillage of drilling fluid displaced when tripping a drill string or casing string into the hole. A second lifting pump is used to remove mixed drilling fluid and seawater from the buffer chamber during wash down operations. The first and second lifting pumps may be of a positive displacement pump type or a kinetic pump type. A third and fourth pump may be included to provide redundant lifting mechanisms for either or both first and second pump. One skilled in the art may derive many configurations of lifting pump and manifold arrangements.

In one embodiment of the riserless marine package, one or more flow metering devices is used measure inlet flow or discharge flow from each lifting pump. Expected returns flow rate from one of or any of the pumps may be inferred from the pump shaft rotation rate, differential pressure correlations, and/or expected fluid properties. An optional secondary flow meter may be included to measure the actual returns fluid flow rate. The secondary flow meter may be a Coriolis flow meter in some applications. Readings for expected and measured flow may be transmitted electronically to the surface or processed on a subsea system and used by other components on the riserless marine package.

In one embodiment of the riserless marine package, readings for expected or measured flow from a seawater injection pump and a buffer return lifting pump may be transmitted electronically to the surface or processed on a subsea system. Readings for expected or measured volumetric flow from a seawater injection pump and a buffer return lifting pump may be compared to determine a net flow rate in or out of a buffer chamber, where the ideal net flow rate in or out of a buffer chamber may be zero. Readings for expected or measured volumetric flow from a seawater injection pump may be used as a control input for a buffer return lifting pump to control the speed of the pump and flow rate out of the buffer chamber where the ideal net flow rate in or out of a buffer chamber may be zero. Readings for expected or measured volumetric flow from a buffer return lifting pump may be used as a control input for a seawater injection pump to control the speed of the pump and flow rate into the buffer chamber where the ideal net flow rate in or out of a buffer chamber may be zero. Maintenance of zero net flow into or out of a buffer chamber may achieved with a top end sealing device closed or with a top end sealing device open.

In one embodiment of the riserless marine package, provisions are made for a detachable drilling returns gooseneck assembly to conduct return fluids from an annular fluid exit port to a flow line leading to an offset riser. In one embodiment of the riserless marine package, fluid flows directly from an annular fluid exit port to a detachable drilling returns gooseneck assembly and into a flexible flow line connected to an offset riser. In another embodiment of the riserless marine package, fluid flows from an annular fluid exit port to a returns manifold, then to a detachable drilling returns gooseneck assembly and into a flexible flow line connected to an offset riser. In another embodiment of the riserless marine package, an interlocking system of valves allows fluid to flow from an annular fluid exit port toward a flexible flow line connected to an offset riser when in riserless mode while blocking flow toward an offset riser in conventional mode.

In one embodiment of the riserless marine package, a subsea flow metering device upstream of a detachable drilling returns gooseneck assembly measures the volumetric or mass flow rate from the well prior to entry into a flow line. In one embodiment of the riserless marine package, a surface flow metering device at the surface measures the volumetric or mass flow rate of drilling returns prior to the transit to the mud cleaning systems. In one embodiment of the riserless marine package, measurements from a subsea flow metering device and measurements from a surface flow metering device are compared to indicate the position of drilled cuttings in an offset riser. In one embodiment of the riserless marine package, pressure measurements from a subsea return flow line are used in combination with a known depth to calculate the average density of return drilling fluid in an offset riser.

In one embodiment of the riserless marine package, provisions are made for a detachable buffer returns gooseneck assembly to conduct return fluids from a buffer chamber to a flow line leading to an offset riser. In one embodiment of the riserless marine package, fluid flows from a buffer chamber to a first, second, third, or fourth lifting pump. In one embodiment of the riserless marine package, buffer return fluids from a lifting pump flow to a dedicated return line on an offset riser to prevent mixing of buffer return fluids and drilling return fluids. In one embodiment of the riserless marine package, flows through a detachable gooseneck assembly from returns manifold or lifting pump toward an offset riser.

In one embodiment of the riserless marine package, a subsea flow metering device upstream of a detachable buffer returns gooseneck assembly measures the volumetric or mass flow rate from buffer chamber prior to entry into a flow line. In one embodiment of the riserless marine package, a surface flow metering device at the surface measures the volumetric or mass flow rate of buffer chamber returns prior to downstream processing.

In one embodiment of the riserless marine package, buffer return fluids are mixed with drilling returns, flowing in comingled fashion through a single drilling returns gooseneck assembly, flow line, and offset riser. Provisions are not made for a dedicated buffer returns gooseneck assembly to conduct return fluids from a buffer chamber to simplify the installation and operation of the system.

One aspect of the riserless marine package is that the functionality of the BOP is unchanged. In one embodiment, the existing BOP umbilicals remain usable to function the BOP. Functionality to operate a releasable connection between the BOP and RMP in a contingency case is preserved. Functionality to operate one or more annular packers of an LMRP is interlocked to enable a riserless mode and a conventional mode for drilling with a marine drilling riser. In riserless mode, functionality to operate one or more annular packers of an LMRP is blocked or unused. In conventional drilling mode, functionality to operate one or more annular packers of an LMRP is transferred to one or more annular packers of a riserless marine package. In one embodiment, the BOP control pods of a riserless marine package are fully compatible with the BOP control pods of an LMRP.

One aspect of the riserless marine package is that the functionality of the RMP is separate from the BOP. In one embodiment, a separate umbilical and control pod function the RMP. This allows rig to run the RMP with a dedicated umbilical during riserless operations and to isolate the RMP functionality in conventional mode. In one embodiment, two separate, redundant umbilicals and control pods function the RMP. This allows rig to operate the RMP with a damaged umbilical or control pod.

Another aspect of the riserless marine package is that interlocking control valves on the RMP may be used to function the RMP lower seal group annular packers in place of the LMRP annular packers in conventional mode. This allows the RMP to provide full LMRP functionality in conventional mode and full riserless capability in riserless mode.

Additional elements of riserless drilling system are employed at the rig floor. With the riser installed in a conventional deepwater marine drilling system, any fluids which leak through features in table are caught in the diverter and join drilling returns in transit to the mud processing equipment. With the riser installed in a deepwater marine drilling system using ASBP MPD, any fluids which leak through features in table are caught in the diverter and join fluids which bypass a wellbore sealing device, eventually in transit to the mud processing equipment. With the riser removed, the bottom of the diverter housing is open to the moonpool below.

In one embodiment, a sealing mechanism not residing on the riserless marine package is inserted to a diverter assembly which is located under the rotary table. In one embodiment, the diverter sealing mechanism includes a passive sealing element. In one embodiment, the diverter sealing mechanism includes a passive sealing element attached to a bearing assembly. In one embodiment, the diverter sealing mechanism includes an active sealing element consisting of one or more materials including polyurethane or PTFE.

The riserless marine package provides a rig with a multimodal replacement for a convention lower marine riser package system. Prior to running the riserless marine package subsea, a rig crew may configure the package for the upcoming operation by selectively activating or deactivating different features of the system. The following represents a high-level overview of the configuration steps when switching between modes for illustration only. Detailed procedures for swapping between modes are implementation specific.

To prepare the riserless marine package for riserless drilling, at minimum the following actions are performed prior to running the system.

The detachable inlet funnel is installed on the upper end connection of the riserless marine package. The operator may install a standalone monitoring package to ensure environmental compliance between the upper end connection of the riserless marine package and the detachable inlet funnel.

The primary umbilical terminal of the blowout prevent and lower marine riser package primary umbilical or equivalent thereof is attached to its corresponding control pod on the riserless marine package. The backup umbilical terminal of the blowout prevent and lower marine riser package backup umbilical or equivalent thereof is attached to its corresponding control pod on the riserless marine package. The primary umbilical terminal of the riserless marine package primary umbilical or equivalent thereof is attached to its corresponding control pod on the riserless marine package.

External process flow lines including drilling fluid return, choke auxiliary line, kill auxiliary line, hydraulic supply auxiliary line, and optional mixed fluid return and optional boost fluid auxiliary lines are attached to corresponding points for riserless operations. Valves in each respective process flow line are lined up appropriately for riserless drilling operations. Process flow line valves may be interlocking electronically or hydraulically actuated valves or manual valves which are actuated by hand and verified manually. Notably, flow paths from each respective line are arranged for drilling with an offset riser and flow paths toward the upper end detachable connection are isolated.

The running tool may also be pre-installed using the riserless marine package control system. An operator may issue a command to the system to extend a lower array of latching cylinders disposed below a multipurpose annular packer. The running tool can then be picked up and run into the riserless marine package, landing on the extended latching cylinders. Once in place, the operator may issue a command to the system to extend an upper array of latching cylinders disposed above a multipurpose annular packer.

To prepare the riserless marine package for conventional drilling with a marine riser, at minimum the following actions are performed prior to running the system.

The detachable inlet funnel is removed from the upper end connection of the riserless marine package. In its place, the operator installs a flexible joint and riser termination assembly or the equivalent thereof to the upper end connection of the riserless marine package and the detachable inlet funnel. The riser termination flange includes a termination flange connection compatible with the rigs riser system which sits atop the flexible joint. From the termination flange, flexible jumper lines connect the choke, kill, hydraulic, and boost functions of the auxiliary lines disposed around the main tube of the riser to their corresponding functions on the riserless marine package and BOP. The jumper lines may be flexible from the termination flange to the corresponding function, or the jumper lines may include flexible portions across the flexible joint and hard piping elsewhere.

The primary umbilical terminal of the blowout prevent and lower marine riser package primary umbilical is attached to its corresponding control pod on the riserless marine package. The backup umbilical terminal of the blowout prevent and lower marine riser package backup umbilical is attached to its corresponding control pod on the riserless marine package. If the operator intends to operate a retrievable sealing element within the riserless marine package, the primary umbilical terminal of the riserless marine package primary umbilical is attached to its corresponding control pod on the riserless marine package. If the operator does not intend to operate a retrievable sealing element within the riserless marine package, the primary umbilical terminal of the riserless marine package may be isolated and the system operated as a conventional lower marine riser package.

External process flow lines for riserless operations are detached and ports are isolated. Valves in each respective process flow line are lined up appropriately for drilling operations with a conventional marine riser. Process flow line valves may be interlocking electronically or hydraulically actuated valves or manual valves which are actuated by hand and verified manually. Notably, flow paths from each respective line are arranged for drilling with a conventional marine drilling riser and flow paths toward the upper end detachable connection are open while external process flow lines for riserless operations are isolated.

In conventional mode with a marine drilling riser, a running tool is not necessary because the riserless marine package is attached to the marine drilling riser. As with a conventional lower marine riser package, the riserless marine package in conventional mode is run and retrieved on the end of the drilling riser.

Other preparatory steps may be taken in either mode in addition to those listed above.

In one or more embodiments of the present invention, a riserless marine package 100 may include a housing 300 including an upper connection end 310 and a lower connection end 320, a central bore 110 having an inner diameter 120 corresponding to an inner diameter of a central bore of a subsea blowout preventer, wherein lower connection end 320 of housing 300 fluidly connects riserless marine package 100 to the subsea blowout preventer. Riserless marine package 100 may also include a multi-purpose annular packer and latching mechanism 400 including an annular packer 410*a* having a central bore 110 having an inner diameter 120 corresponding to the inner diameter of the central bore of the subsea blowout preventer, a first upper latching mechanism 800*a* disposed above annular packer 410*a*, and a first lower latching mechanism 800*b* disposed below annular packer 410*a*. Riserless marine package 100 may also include a lower seal group 600 disposed below multi-purpose annular packer and latching mechanism 400 including an upper annular sealing element (e.g., disposed in packer 410*b*) having a central bore 110 having an inner diameter 120 corresponding to the inner diameter of the central bore of the subsea blowout preventer, a second upper latching mechanism 800*c* disposed above upper sealing element (e.g., disposed in packer 410*b*), a second lower latching mechanism 800*d* disposed below the upper sealing element (e.g., disposed in packer 410*b*), a lower annular sealing element (e.g., disposed in packer 410*c*) comprising a central bore 110 having an inner diameter 120 corresponding to the inner diameter of the central bore of the subsea blowout preventer, a third upper latching mechanism 800*e* disposed above the lower sealing element (e.g., disposed in packer 410*c*), and a third lower latching mechanism 800*f* disposed below the lower sealing element (e.g., disposed in packer 410*c*). Riserless marine package 100 may also include a buffer chamber 500 disposed in between multi-purpose annular packer and latching mechanism 400 and lower seal group 600 including a central bore 110 having an inner diameter 120 at least as large as a smallest inner diameter of any other component of riserless marine package 100, a fluid injection port 520, and a fluid return port 515. Riserless marine package 100 may also include an annular fluid return port 700 disposed below lower seal group 600, wherein riserless marine package 100 is removably attached to the subsea blowout preventer and the central bore 110 of riserless marine package 100 is in fluid communication with the central bore of the subsea blowout preventer.

In certain embodiments, housing 300 may further include a multi-purpose annular packer and cartridge latching assembling housing portion 415*a*, an upper sealing element housing portion 415*b*, a lower sealing element housing portion 415*c*, a buffer chamber housing portion 505, and an annular fluid discharge port housing portion 705.

In certain embodiments, riserless marine package 100 may include an input guide 200 including an upper receiving end 205, a passageway 210, and a lower connection end 215 that is removably attached to upper connection end of riserless marine package 100, wherein upper receiving end 310 directs access through passageway 210 that is fluidly connected to central bore 110 of housing 300.

In certain embodiments, passageway 210 of input guide 200 tapers down from a wide inner diameter (205) to an narrow inner diameter (215) corresponding to inner diameter 120 of central bore 110 of housing 300 of riserless marine package 100.

In certain embodiments, riserless marine package 100 may include a riser termination assembly 230 including an upper connection end 235, a central bore 245, a lower connection end 240 that is removably attached to upper connection end 310 of riserless marine package 100, and a central bore 110 having an inner diameter 120 corresponding to the inner diameter 120 of the central bore 110 of housing 300, wherein riserless termination assembly 230 is fluidly connected to riserless marine package 100.

In certain embodiments, riserless marine package 100 may include a retrievable sealing element removably disposed within annular packer 410*a*. In certain embodiments, the retrievable sealing element may be a non-rotating ACD seal sleeve assembly (610). The non-rotating ACD seal sleeve assembly (610) may be landed on first lower latching mechanism 800*b*, secured in place by first upper latching mechanism 800*a*, and controllably actuated by annular packer 410*a* to create a seal on a tubular member disposed therethrough. In certain embodiments, annular packer 410*a* controllably adjusts a closing pressure on the non-rotating ACD seal sleeve assembly (610) to allow a controlled flow of fluid from above to below or from below to above the retrievable sealing element (610).

In certain embodiments, the retrievable sealing element may be an RCD seal and bearing assembly. The RCD seal and bearing assembly may be landed on first lower latching mechanism 800*b* and secured in place by first upper latching mechanism 800*a*, creating an interference fit seal on a tubular member disposed therethrough.

In certain embodiments, during tripping operations without a retrievable sealing element disposed within annular packer 410*a*, annular packer 410*a* of multi-purpose annular packer and latching mechanism 400 controllably seals on a tubular member disposed therethrough to create a seal.

In certain embodiments, during tripping and other operations without a retrievable sealing element disposed within annular packer 410*a*, annular packer 410*a* of multi-purpose annular packer and latching mechanism 400 controllably cleans a tubular member disposed therethrough.

In certain embodiments, each of first upper latching mechanism 800*a* and first lower latching mechanism 800*b* of multi-purpose annular packer and latching mechanism 400 includes a plurality of retractable locking dogs 800 disposed radially around central bore 110 of housing 300.

In certain embodiments, a non-sealing element may be landed on first lower latching mechanism 800*b* and secured in place by first upper latching mechanism 800*a*. In certain embodiments, the non-sealing element includes a running tool having no moving parts, a central bore along a longitudinal axis allowing flow through the tool, and an upper connection end compatible with a lower connection end of drill pipe configured to lift riserless marine package 100 using a rig-based hoisting system.

In certain embodiments, the inner diameter of the central bore of buffer chamber 500 is larger than any other component of riserless marine package 100. In certain embodiments, the fluid return port of buffer chamber 500 is removably attached to a fluid returns manifold.

In certain embodiments, buffer chamber 500 includes a sensor. In certain embodiments, the sensor of buffer chamber 500 comprises a differential pressure sensor that senses an average density of fluid in buffer chamber 500.

In certain embodiments, the sensor of buffer chamber 500 includes a plurality of differential pressure sensors that sense an average density of fluid in buffer chamber 500 at different elevations. In certain embodiments, a reading from a first differential pressure sensor disposed at a higher elevation within buffer chamber 500 is configured to trigger a temporary operation of a lifting pump to remove fluids from buffer chamber 500 until a fluid level within buffer chamber 500 reaches a second differential pressure sensor disposed at a lower elevation within buffer chamber 500. In certain embodiments, fluids in buffer chamber 500 are drawn into a pump that fluidly communicates the fluids through a meter for continuous sampling and then returns the fluids to buffer chamber 500.

In certain embodiments, lower seal group 600 is configured to substantially seal a wellbore annulus and block upward flow of fluid from a wellbore annulus. In certain embodiments, lower seal group 600 includes an upper annular packer system 410*b* and a lower annular packer system 410*c*.

In certain embodiments, upper sealing element of lower seal group 600 is landed on second lower latching mechanism 800*d* and secured in place by second upper latching mechanism 800*c*, and wherein lower sealing element of lower seal group 600 is landed on third lower latching mechanism 800*f* and secured in place by third upper latching mechanism 800*e*.

In certain embodiments, upper sealing element of lower seal group 600 comprises a first active seal and lower sealing element of lower seal group 600 comprises a second active seal.

In certain embodiments, upper sealing element of lower seal group 600 comprises an active seal and the lower sealing element of lower seal group 600 comprises a passive seal. In certain embodiments, upper sealing element of lower seal group 600 comprises a passive seal and the lower sealing element of lower seal group 600 comprises an active seal.

In certain embodiments, upper sealing element of lower seal group 600 comprises a first passive seal and the lower sealing element of lower seal group 600 comprises a second passive seal.

In certain embodiments, the active seal comprises a non-rotating ACD seal sleeve. In certain embodiments, the passive seal comprises an RCD seal and bearing assembly.

In certain embodiments, annular packer 410*a* of multi-purpose annular packer and latching mechanism 400 and any active seal of lower seal group 600 are independently actuated.

In certain embodiments, riserless marine package 100 may include annular fluid return port 700 that is fluidly connected to a returns manifold for return to the surface.

In certain embodiments, lower connection end 320 of housing 300 of riserless marine package 100 is compatible with a standard LMRP/BOP latching mechanism, configured to removably attach riserless marine package 100 to the subsea blowout preventer.

In certain embodiments, riserless marine package 100 may include configurable auxiliary line attachments to selectively divert choke, kill, hydraulic, or boost auxiliary line functions to an offset return riser for riserless drilling mode or to a riser termination assembly 230 for conventional riser drilling mode.

In certain embodiments, riserless marine package 100 may include a subsea gooseneck assembly comprising a choke auxiliary line fluidly connected to a corresponding termination point at the riserless marine package/subsea blowout preventer interface by way of a choke mode selection valve or valve manifold.

In certain embodiments, riserless marine package 100 may include a subsea gooseneck assembly comprising a kill auxiliary line fluidly connected to a corresponding termination point at the riserless marine package/subsea blowout preventer by way of a kill mode selection valve or valve manifold.

In certain embodiments, riserless marine package 100 may include a subsea gooseneck assembly comprising a hydraulic auxiliary line fluidly connected to a corresponding termination point at the riserless marine package/subsea blowout preventer by way of a hydraulic mode selection valve or valve manifold.

In certain embodiments, riserless marine package 100 may include at least three control umbilicals, at least three umbilical terminals, and at least three control pods.

One of ordinary skill in the art, having the benefit of this disclosure, will recognize that one or more non-transitory computer-readable media may comprise software instructions that, when executed by a processor, may perform one or more of the above-noted methods in accordance with one or more embodiments of the present invention.

Advantages of one or more embodiments of the present invention may include one or more of the following:

In one or more embodiments of the present invention, a riserless marine package enables post-BOP utilization of both drill centers simultaneously using a conventional offset riser system and associated support systems to significantly reduce turnaround time between drilling and casing operations and substantially reduce associated costs.

In one or more embodiments of the present invention, a riserless marine package may include an ACD system disposed above the subsea BOP that separates drilling mud below the sealing system from the seawater above the riserless marine package.

In one or more embodiments of the present invention, a riserless marine package may enable the drilling rig to assemble and operate a drillstring from a first drilling position and assemble and operate a casing or liner string from a second drilling position simultaneously.

In one or more embodiments of the present invention, a riserless marine package may enable the drilling rig to, upon reaching total depth using the offset riser, trip the drillstring until the BHA clears the subsea BOP and then move to insert a casing string hanging from the second drilling position.

In one or more embodiments of the present invention, a riserless marine package ma enable the drilling rig to trip out casing running tools after a casing string is cemented in place and insert a ready drill string once the casing tools have cleared the subsea BOP stack.

In one or more embodiments of the present invention, a riserless marine package allows the drilling rig to substantially reduce tripping time and rig floor configuration time from the critical path of operations. By reducing the amount of time on location, the amount of fuel that is consumed, and the amount of emissions produced, the overall well construction cost is substantially reduced.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should only be limited by the appended claims.

What is claimed is:

1. A riserless marine package comprising:

a housing comprising:

an upper connection end, a lower connection end, and a central bore having an inner diameter corresponding to an inner diameter of a central bore of a subsea blowout preventer, wherein the lower connection end of the housing fluidly connects the riserless marine package to the subsea blowout preventer;

a multi-purpose annular packer and latching mechanism comprising:

an annular packer comprising a central bore having an inner diameter corresponding to the inner diameter of the central bore of the subsea blowout preventer, a first upper latching mechanism disposed above the annular packer, and a first lower latching mechanism disposed below the annular packer;

a lower seal group disposed below the multi-purpose annular packer and latching mechanism comprising:

an upper annular sealing element comprising a central bore having an inner diameter corresponding to the inner diameter of the central bore of the subsea blowout preventer, a second upper latching mechanism disposed above the upper sealing element, a second lower latching mechanism disposed below the upper sealing element, a lower annular sealing element comprising a central bore having an inner diameter corresponding to the inner diameter of the central bore of the subsea blowout preventer, a third upper latching mechanism disposed above the lower sealing element, and a third lower latching mechanism disposed below the lower sealing element;

a buffer chamber disposed in between the multi-purpose annular packer and latching mechanism and the lower seal group comprising:

a central bore having an inner diameter at least as large as a smallest inner diameter of any other component of the riserless marine package, a fluid injection port, and a fluid return port; and an annular fluid return port disposed below the lower seal group, wherein the riserless marine package is removably attached to the subsea blowout preventer and the central bore of the riserless marine package is in fluid communication with the central bore of the subsea blowout preventer.

2. The riserless marine package of claim 1, wherein the housing further comprises:

a multi-purpose annular packer and cartridge latching assembling housing portion, an upper sealing element housing portion, a lower sealing element housing portion, a buffer chamber housing portion, and an annular fluid discharge port housing portion.

3. The riserless marine package of claim 1, further comprising:

an input guide comprising an upper receiving end, a passageway, and a lower connection end that is removably attached to the upper connection end of the riserless marine package, wherein the upper receiving end directs access through the passageway that is fluidly connected to the central bore of the housing.

4. The riserless marine package of claim 3, wherein the passageway of the input guide tapers down from a wide inner diameter to an narrow inner diameter corresponding to the inner diameter of the central bore of the housing of the riserless marine package.

5. The riserless marine package of claim 1, further comprising:

a riser termination assembly comprising an upper connection end, a central bore, a lower connection end that is removably attached to the upper connection end of the riserless marine package, and a central bore having an inner diameter corresponding to the inner diameter of the central bore of the housing, wherein the riserless termination assembly is fluidly connected to the riserless marine package.

6. The riserless marine package of claim 1, further comprising:

a retrievable sealing element removably disposed within the annular packer.

7. The riserless marine package of claim 6, wherein the retrievable sealing element comprises a non-rotating ACD seal sleeve assembly.

8. The riserless marine package of claim 7, wherein the non-rotating ACD seal sleeve assembly is landed on the first lower latching mechanism, secured in place by the first upper latching mechanism, and controllably actuated by the annular packer to create a seal on a tubular member disposed therethrough.

9. The riserless marine package of claim 7, wherein the non-rotating ACD seal sleeve assembly is landed on the first lower latching mechanism, secured in place by the first upper latching mechanism, and the annular packer controllably adjusts a closing pressure on the non-rotating ACD seal sleeve assembly to allow a controlled flow of fluid from above to below or from below to above the retrievable sealing element.

10. The riserless marine package of claim 7, wherein the retrievable sealing element comprises an RCD seal and bearing assembly.

11. The riserless marine package of claim 10, wherein the RCD seal and bearing assembly is landed on the first lower latching mechanism and secured in place by the first upper latching mechanism, creating an interference fit seal on a tubular member disposed therethrough.

12. The riserless marine package of claim 1, wherein, during tripping operations without a retrievable sealing element disposed within the annular packer, the annular packer of the multi-purpose annular packer and latching mechanism controllably seals on a tubular member disposed therethrough to create a seal.

13. The riserless marine package of claim 1, wherein, during tripping and other operations without a retrievable sealing element disposed within the annular packer, the annular packer of the multi-purpose annular packer and latching mechanism controllably cleans a tubular member disposed therethrough.

14. The riserless marine package of claim 1, wherein each of the first upper latching mechanism and the first lower latching mechanism of the multi-purpose annular packer and latching mechanism comprise a plurality of retractable locking dogs disposed radially around the central bore of the housing.

15. The riserless marine package of claim 1, wherein a non-sealing element is secured in place by one or more latching mechanisms of the riserless marine package.

16. The riserless marine package of claim 15, wherein the non-sealing element comprises a running tool comprising no moving parts, a central bore along a longitudinal axis allowing flow through the tool, and an upper connection end compatible with a lower connection end of drill pipe, wherein the running tool is inserted into the riserless marine package, latched in place using one or more latching mechanisms of the riserless marine package, and the upper connection end is connected to a drill string under a drilling rig floor that is configured to lift the riserless marine package using the drilling rig-based hoisting system.

17. The riserless marine package of claim 1, wherein the inner diameter of the central bore of the buffer chamber is larger than any other component of the riserless marine package.

18. The riserless marine package of claim 1, wherein the fluid return port of the buffer chamber is removably attached to a fluid returns manifold.

19. The riserless marine package of claim 1, wherein the buffer chamber comprises a sensor.

20. The riserless marine package of claim 19, wherein the sensor of the buffer chamber comprises a differential pressure sensor that senses an average density of fluid in the buffer chamber.

21. The riserless marine package of claim 19, wherein the sensor of the buffer chamber comprises a plurality of differential pressure sensors that sense an average density of fluid in the buffer chamber at different elevations.

22. The riserless marine package of claim 21, wherein a reading from a first differential pressure sensor disposed at a higher elevation within the buffer chamber is configured to trigger a temporary operation of a lifting pump to remove fluids from the buffer chamber until a fluid level within the buffer chamber reaches a second differential pressure sensor disposed at a lower elevation within the buffer chamber.

23. The riserless marine package of claim 1, wherein fluids in the buffer chamber are drawn into a pump that fluidly communicates the fluids through a meter for continuous sampling and then returns the fluids to the buffer chamber.

24. The riserless marine package of claim 1, wherein the lower seal group is configured to substantially seal a wellbore annulus and block upward flow of fluid from a wellbore annulus.

25. The riserless marine package of claim 1, wherein the lower seal group comprises an upper annular packer system and a lower annular packer system.

26. The riserless marine package of claim 1, wherein the upper sealing element of the lower seal group is landed on the second lower latching mechanism and secured in place by the second upper latching mechanism, and wherein the lower sealing element of the lower seal group is landed on the third lower latching mechanism and secured in place by the third upper latching mechanism.

27. The riserless marine package of claim 1, wherein the upper sealing element of the lower seal group comprises a first active seal and the lower sealing element of the lower seal group comprises a second active seal.

28. The riserless marine package of claim 1, wherein the upper sealing element of the lower seal group comprises an active seal and the lower sealing element of the lower seal group comprises a passive seal.

29. The riserless marine package of claim 1, wherein the upper sealing element of the lower seal group comprises a passive seal and the lower sealing element of the lower seal group comprises an active seal.

30. The riserless marine package of claim 1, wherein the upper sealing element of the lower seal group comprises a first passive seal and the lower sealing element of the lower seal group comprises a second passive seal.

31. The riserless marine package of claim 27, wherein the active seal comprises a non-rotating ACD seal sleeve.

32. The riserless marine package of claim 28, wherein the passive seal comprises an RCD seal and bearing assembly.

33. The riserless marine package of claim 27, wherein the annular packer of the multi-purpose annular packer and latching mechanism and any active seal of the lower seal group are independently actuated.

34. The riserless marine package of claim 1, wherein the annular fluid return port is fluidly connected to a returns manifold for return to the surface.

35. The riserless marine package of claim 1, wherein the lower connection end of the housing of the riserless marine package is compatible with a standard LMRP/BOP latching mechanism, configured to removably attach the riserless marine package to the subsea blowout preventer.

36. The riserless marine package of claim 1, further comprising configurable auxiliary line attachments to selectively divert choke, kill, hydraulic, or boost auxiliary line functions to an offset return riser for riserless drilling mode or to a riser termination assembly for conventional riser drilling mode.

37. The riserless marine package of claim 1, further comprising a subsea gooseneck assembly comprising a choke auxiliary line fluidly connected to a corresponding termination point at the riserless marine package/subsea blowout preventer interface by way of a choke mode selection valve or valve manifold.

38. The riserless marine package of claim 1, further comprising a subsea gooseneck assembly comprising a kill auxiliary line fluidly connected to a corresponding termination point at the riserless marine package/subsea blowout preventer by way of a kill mode selection valve or valve manifold.

39. The riserless marine package of claim 1, further comprising a subsea gooseneck assembly comprising a hydraulic auxiliary line fluidly connected to a corresponding termination point at the riserless marine package/subsea blowout preventer by way of a hydraulic mode selection valve or valve manifold.

40. The riserless marine package of claim 1, further comprising at least three control umbilicals, at least three umbilical terminals, and at least three control pods.

41. The riserless marine package of claim 40, wherein two of the three or more control umbilicals are compatible with a conventional lower marine riser package, two of the three or more umbilicals terminals are compatible with a conventional lower marine riser package, and two of the three or more control pods are compatible with a conventional lower marine riser package.

42. The riserless marine package of claim 28, wherein the active seal comprises a non-rotating ACD seal sleeve.

43. The riserless marine package of claim 29, wherein the active seal comprises a non-rotating ACD seal sleeve.

44. The riserless marine package of claim 29, wherein the passive seal comprises an RCD seal and bearing assembly.

45. The riserless marine package of claim 30, wherein the passive seal comprises an RCD seal and bearing assembly.

46. The riserless marine package of claim 28, wherein the annular packer of the multi-purpose annular packer and latching mechanism and any active seal of the lower seal group are independently actuated.

47. The riserless marine package of claim 29, wherein the annular packer of the multi-purpose annular packer and latching mechanism and any active seal of the lower seal group are independently actuated.

* * * * *